US010308885B2

(12) United States Patent
Fridman et al.

(10) Patent No.: US 10,308,885 B2
(45) Date of Patent: Jun. 4, 2019

(54) DIRECT INCORPORATION OF NATURAL GAS INTO HYDROCARBON LIQUID FUELS

(71) Applicants: Alexander Fridman, Philadelphia, PA (US); Alexander Rabinovich, Cherry Hill, NJ (US); Danil Dobrynin, Philadelphia, PA (US); Ivan Chernets, Haddonfield, NJ (US); Chong Liu, Philadelphia, PA (US)

(72) Inventors: Alexander Fridman, Philadelphia, PA (US); Alexander Rabinovich, Cherry Hill, NJ (US); Danil Dobrynin, Philadelphia, PA (US); Ivan Chernets, Haddonfield, NJ (US); Chong Liu, Philadelphia, PA (US)

(73) Assignee: DREXEL UNIVERSITY, Philadelphia, PA (US)

( * ) Notice: Subject to any disclaimer, the term of this patent is extended or adjusted under 35 U.S.C. 154(b) by 178 days.

(21) Appl. No.: 15/528,823

(22) PCT Filed: Dec. 2, 2015

(86) PCT No.: PCT/US2015/063423
§ 371 (c)(1),
(2) Date: May 23, 2017

(87) PCT Pub. No.: WO2016/089994
PCT Pub. Date: Jun. 9, 2016

(65) Prior Publication Data

US 2018/0171249 A1 Jun. 21, 2018

Related U.S. Application Data

(60) Provisional application No. 62/086,795, filed on Dec. 3, 2014.

(51) Int. Cl.
*C10G 32/02* (2006.01)
*C10L 1/04* (2006.01)
*F17C 11/00* (2006.01)

(52) U.S. Cl.
CPC ..... *C10L 1/04* (2013.01); *C10G 32/02* (2013.01); *F17C 11/007* (2013.01); (Continued)

(58) Field of Classification Search
CPC ..... C10G 32/00; C10G 32/02; C10G 32/04; C10L 1/04; C10L 2250/06; C10L 2290/36; C10L 2290/38; C10L 2290/143
See application file for complete search history.

(56) References Cited

U.S. PATENT DOCUMENTS 606,876 A 7/1898 Payet
2,438,029 A 3/1948 Atwell
(Continued)

FOREIGN PATENT DOCUMENTS

CA 1011283 5/1977
CA 1081654 7/1980
(Continued)

OTHER PUBLICATIONS

Shirai, Naoki, et al. "DC corona and glow discharges generated along the intersecting axial miniature gas flows under atmospheric pressure air." Applied physics express 2.7 (2009): 076001.
(Continued)

*Primary Examiner* — Michelle Stein
(74) *Attorney, Agent, or Firm* — Mendelsohn Dunleavy, P.C.

(57) ABSTRACT

The present invention provides a method of incorporating a gaseous hydrocarbon into a liquid hydrocarbon. The method comprises steps of exposing a gaseous hydrocarbon to non-thermal plasma generated using a reduced electric field
(Continued)

with an E/N ratio in a range of from about 10 to about 30 Td to activate the gaseous hydrocarbon, and contacting the activated gaseous hydrocarbon with the liquid hydrocarbon to incorporate the gaseous hydrocarbon into the liquid hydrocarbon. The method provides the advantages of low energy consumption and relatively low capital expenditure.

20 Claims, 16 Drawing Sheets

(52) U.S. Cl.
CPC ..... *C10L 2250/06* (2013.01); *C10L 2290/143* (2013.01); *C10L 2290/36* (2013.01); *C10L 2290/38* (2013.01)

(56) References Cited

U.S. PATENT DOCUMENTS 2,474,845 A 7/1949 Jenny et al.
2,667,521 A 1/1954 Harney
3,095,286 A 6/1963 Andress, Jr. et al.
3,189,531 A 6/1965 Hack et al.
3,346,494 A 10/1967 Robbins et al.
3,421,870 A 1/1969 Sinfelt et al.
3,441,498 A 4/1969 Jubin, Jr. et al.
3,639,242 A 2/1972 Le Suer
3,755,169 A 8/1973 Adams
3,830,301 A 8/1974 Holm
3,859,318 A 1/1975 Lesuer
3,868,330 A 2/1975 Meinhardt et al.
3,876,391 A 4/1975 McCoy et al.
3,879,308 A 4/1975 Miller
3,948,800 A 4/1976 Meinhardt
3,957,854 A 5/1976 Miller
3,957,855 A 5/1976 Miller
4,031,118 A 6/1977 Miller
4,046,519 A 9/1977 Piotrowski
4,158,594 A 6/1979 Becker et al.
4,185,594 A 1/1980 Perilstein
4,193,864 A 3/1980 Chang
4,225,456 A 9/1980 Schmidt et al.
4,248,720 A 2/1981 Coupland et al.
4,329,249 A 5/1982 Forsberg
4,368,133 A 1/1983 Forsberg
4,389,303 A 6/1983 Simo et al.
4,419,466 A 12/1983 Hopkins
4,447,348 A 5/1984 Forsberg
4,448,703 A 5/1984 Forsberg
4,465,889 A 8/1984 Anthony et al.
4,471,091 A 9/1984 Hayashi
4,486,573 A 12/1984 Hayashi
4,489,194 A 12/1984 Hayashi
4,493,761 A 1/1985 Hensley, Jr. et al.
4,509,955 A 4/1985 Hayashi
4,526,586 A 7/1985 Schwab et al.
4,559,155 A 12/1985 Dorer, Jr. et al.
4,564,460 A 1/1986 Dorer, Jr. et al.
4,566,961 A * 1/1986 Diaz ..... C10G 15/12 204/168
4,566,983 A 1/1986 Hayashi
4,575,526 A 3/1986 Dorer, Jr. et al.
4,596,663 A 6/1986 Hayashi
4,613,342 A 9/1986 Dorer, Jr. et al.
4,618,450 A 10/1986 Higgins
4,619,967 A 10/1986 Emerson et al.
4,623,684 A 11/1986 Dorer, Jr. et al.
4,666,620 A 5/1987 Forsberg
4,687,570 A 8/1987 Sundaram et al.
4,687,590 A 8/1987 Haack
4,706,751 A 11/1987 Gondouin
4,708,753 A 11/1987 Forsberg
4,710,248 A 12/1987 Yates et al.
4,744,796 A 5/1988 Hazbun et al.
4,752,383 A 6/1988 McKay et al.
4,767,449 A 8/1988 Rosen et al.
4,770,670 A 9/1988 Hazbun et al.
4,818,309 A 4/1989 Yabsley et al.
4,828,633 A 5/1989 Forsberg
4,832,868 A 5/1989 Schmid et al.
4,840,687 A 6/1989 Forsberg et al.
4,844,756 A 7/1989 Forsberg
4,846,985 A 7/1989 Rizvi et al.
4,863,534 A 9/1989 Forsberg
4,919,178 A 4/1990 Riga et al.
4,936,933 A 6/1990 Yabsley et al.
4,950,831 A 8/1990 Staton et al.
4,957,651 A 9/1990 Schwind
5,007,973 A 4/1991 Trapp et al.
5,015,349 A 5/1991 Suib et al.
5,019,355 A 5/1991 Sackinger
5,041,622 A 8/1991 LeSuer
5,047,175 A 9/1991 Forsberg
5,069,775 A 12/1991 Grosboll
5,110,452 A 5/1992 Meyer et al.
5,120,430 A 6/1992 Morgan
5,129,972 A 7/1992 Riga et al.
5,131,993 A 7/1992 Suib et al.
5,177,045 A 1/1993 Anthony et al.
5,181,998 A 1/1993 Murphy et al.
5,213,697 A 5/1993 Vinci et al.
5,233,113 A 8/1993 Periana et al.
5,259,851 A 11/1993 Genova et al.
5,269,909 A 12/1993 Ovalles et al.
5,283,235 A 2/1994 Bush et al.
5,330,662 A 7/1994 Jahnke et al.
5,336,439 A 8/1994 Forsberg et al.
5,344,306 A 9/1994 Brown et al.
5,345,011 A 9/1994 Durante et al.
5,360,458 A 11/1994 Forsberg et al.
5,397,399 A 3/1995 Lownds
5,401,341 A 3/1995 Forsberg et al.
5,407,500 A 4/1995 Forsberg et al.
5,422,024 A 6/1995 Vickerman et al.
5,427,747 A 6/1995 Kong et al.
5,484,542 A 1/1996 Cahoon et al.
5,501,714 A 3/1996 Valentine et al.
5,527,491 A 6/1996 Riga et al.
5,584,222 A 12/1996 Engsbråten et al.
5,593,953 A 1/1997 Malchow, Jr.
5,620,946 A 4/1997 Jahnke et al.
5,633,220 A 5/1997 Cawiezel et al.
5,637,557 A 6/1997 Jahnke et al.
5,693,106 A 12/1997 Peter-Hoblyn et al.
5,809,774 A 9/1998 Peter-Hoblyn et al.
5,851,429 A 12/1998 Magyar
5,856,279 A 1/1999 Baker
5,891,829 A 4/1999 Vallejos et al.
5,906,664 A 5/1999 Basu et al.
5,920,031 A 7/1999 Jahnke
5,936,194 A 8/1999 Marlow et al.
6,054,493 A 4/2000 Bush
6,110,378 A 8/2000 Anthony et al.
6,130,260 A 10/2000 Hall et al.
6,147,036 A 11/2000 Baker
6,159,432 A 12/2000 Mallinson et al.
6,176,893 B1 1/2001 Bush
6,190,427 B1 2/2001 Ahmed
6,200,398 B1 3/2001 Bush
6,207,839 B1 3/2001 Baker
6,229,060 B1 5/2001 Vidal et al.
6,280,485 B1 8/2001 Daly et al.
6,323,247 B1 11/2001 Hall et al.
6,326,407 B1 12/2001 Eliasson et al.
6,368,366 B1 4/2002 Langer et al.
6,368,367 B1 4/2002 Langer et al.
6,375,832 B1 4/2002 Eliasson et al.
6,383,237 B1 5/2002 Langer et al.
6,386,149 B1 5/2002 Coleman et al.
6,419,714 B2 7/2002 Thompson et al.
6,479,427 B1 11/2002 Anthony et al.
6,530,964 B2 3/2003 Langer et al.
6,538,162 B2 3/2003 Chang et al.

(56) References Cited

U.S. PATENT DOCUMENTS 6,593,377 B1 7/2003 Harford et al.
6,602,920 B2 8/2003 Hall et al.
6,606,856 B1 8/2003 Brown et al.
6,630,596 B2 10/2003 Boer
6,648,929 B1 11/2003 Daly et al.
6,652,607 B2 11/2003 Langer et al.
6,716,801 B2 4/2004 Martin
6,725,653 B2 4/2004 Brown et al.
6,727,397 B2 4/2004 Basset et al.
6,748,905 B2 6/2004 Duncan et al.
6,780,209 B1 8/2004 Filippini et al.
6,800,154 B1 10/2004 Carey et al.
6,823,822 B2 11/2004 Duncan et al.
6,827,749 B2 12/2004 Westfall et al.
6,858,046 B2 2/2005 Daly et al.
6,896,854 B2 5/2005 Kong et al.
6,913,630 B2 7/2005 Filippini et al.
6,923,890 B2 8/2005 Ricatto et al.
6,929,707 B2 8/2005 Mullay et al.
6,933,263 B2 8/2005 Manka et al.
6,939,420 B2 9/2005 Pollack
6,949,235 B2 9/2005 Brown et al.
6,951,589 B2 10/2005 Pollack et al.
7,028,468 B2 4/2006 Brown et al.
7,029,636 B2 4/2006 Ricatto et al.
7,044,988 B2 5/2006 Filippini et al.
7,119,240 B2 10/2006 Hall et al.
7,176,174 B2 2/2007 Filippini et al.
7,229,481 B2 6/2007 Clark et al.
7,270,743 B2 9/2007 Freel et al.
7,307,104 B2 12/2007 Qiu et al.
7,309,684 B2 12/2007 Filippini et al.
7,329,719 B2 2/2008 Pavlin
7,378,564 B2 5/2008 Basset et al.
7,413,583 B2 8/2008 Langer et al.
7,427,303 B2 9/2008 Sarin et al.
7,435,707 B2 10/2008 Langer et al.
7,451,618 B2 11/2008 Ansorge et al.
7,473,814 B2 1/2009 Basset et al.
7,479,576 B1 1/2009 Hassan et al.
7,482,496 B2 1/2009 Hassan et al.
7,482,497 B2 1/2009 Hassan et al.
7,484,358 B2 2/2009 Cho et al.
7,491,247 B1 2/2009 Jakush et al.
7,491,279 B1 2/2009 Baker
7,491,856 B2 2/2009 Hassan et al.
7,494,574 B2 2/2009 Kong et al.
7,501,054 B2 3/2009 Galiasso
7,501,374 B2 3/2009 Galiasso
7,592,493 B2 9/2009 Hassan et al.
7,642,292 B2 1/2010 Severinsky
7,645,305 B1 1/2010 Coleman et al.
7,651,984 B2 1/2010 Cook et al.
7,652,174 B2 1/2010 Hassan et al.
7,652,175 B2 1/2010 Hassan et al.
7,659,431 B2 2/2010 Hassan et al.
7,691,953 B2 4/2010 Hassan et al.
7,696,391 B2 4/2010 Hassan et al.
7,704,288 B2 4/2010 Rivas et al.
7,721,719 B2 5/2010 Okajima et al.
7,722,688 B2 5/2010 Filippini et al.
7,736,400 B2 6/2010 Rabovitser et al.
7,749,481 B2 7/2010 Hassan et al.
7,750,188 B2 7/2010 Hassan et al.
7,759,535 B2 7/2010 Iaccino et al.
7,762,715 B2 7/2010 Gordon et al.
7,772,447 B2 8/2010 Iaccino et al.
7,790,018 B2 9/2010 Khan
7,806,947 B2 10/2010 Gunnerman et al.
7,842,184 B2 11/2010 Hassan et al.
7,884,250 B2 2/2011 Hassan et al.
7,897,124 B2 3/2011 Gunnerman et al.
7,949,574 B2 5/2011 Patel et al.
8,052,946 B2 11/2011 Dighe et al.
8,097,166 B2 1/2012 Nakashima
8,728,182 B2 5/2014 Sirdeshpande et al.
2002/0000085 A1 1/2002 Hall et al.
2002/0088167 A1 7/2002 Filippini et al.
2002/0116868 A1 8/2002 Westfall et al.
2002/0129541 A1 9/2002 Daly et al.
2003/0019552 A1 1/2003 Pollack et al.
2003/0065058 A1 4/2003 Piedrahita et al.
2003/0138373 A1 7/2003 Graham et al.
2003/0164147 A1 9/2003 Duncan et al.
2003/0221360 A1 12/2003 Brown et al.
2003/0233019 A1 12/2003 Sherwood
2004/0002553 A1 1/2004 Hall et al.
2004/0016479 A1 1/2004 Mullay et al.
2004/0020574 A1 2/2004 Pollack
2004/0053791 A1 3/2004 Langer et al.
2004/0093789 A1 5/2004 Hart et al.
2004/0093790 A1 5/2004 Baker et al.
2004/0111955 A1 6/2004 Mullay et al.
2004/0111956 A1 6/2004 Westfall et al.
2004/0111957 A1 6/2004 Filippini et al.
2004/0139931 A1 7/2004 Duncan et al.
2004/0176263 A1 9/2004 Filippini et al.
2004/0194367 A1 10/2004 Clark et al.
2004/0235678 A1 11/2004 Di Biase et al.
2004/0235684 A1 11/2004 Cook et al.
2004/0237383 A1 12/2004 Daly
2004/0244277 A1 12/2004 Baker et al.
2004/0248747 A1 12/2004 Mayhew et al.
2005/0000149 A1 1/2005 Moncrieff et al.
2005/0008906 A1 1/2005 Varadaraj et al.
2005/0019624 A1 1/2005 Varadaraj et al.
2005/0019625 A1 1/2005 Varadaraj et al.
2005/0022445 A1 2/2005 Sarin et al.
2005/0027020 A1 2/2005 Steynberg
2005/0039381 A1 2/2005 Langer et al.
2005/0049316 A1 3/2005 Burrington et al.
2005/0060928 A1 3/2005 Oldfield et al.
2005/0065391 A1 3/2005 Gattis et al.
2005/0097812 A1 5/2005 Guffogg et al.
2005/0115146 A1 6/2005 Jackson et al.
2005/0120619 A1 6/2005 Koch et al.
2005/0132640 A1 6/2005 Kelly et al.
2005/0150155 A1 7/2005 Waldron et al.
2005/0183324 A1 8/2005 Marelli
2005/0215441 A1 9/2005 Mackney et al.
2005/0250863 A1 11/2005 Green et al.
2005/0262759 A1 12/2005 Tort et al.
2005/0288541 A1 12/2005 Sherwood
2006/0005463 A1 1/2006 Gernon et al.
2006/0005464 A1 1/2006 Gernon et al.
2006/0048443 A1 3/2006 Filippini et al.
2006/0054865 A1 3/2006 Smith et al.
2006/0075680 A1 4/2006 Tort et al.
2006/0117647 A1 6/2006 Rivolta et al.
2006/0123695 A1 6/2006 D'Elia et al.
2006/0135838 A1 6/2006 Bagherzadeh et al.
2006/0162237 A1 7/2006 Mullay et al.
2006/0162240 A1 7/2006 Filippini et al.
2006/0204461 A1 9/2006 Pavlin
2006/0236596 A1 10/2006 Baxter
2006/0287560 A1 12/2006 Xie
2007/0027046 A1 2/2007 Friend et al.
2007/0028507 A1 2/2007 Strey et al.
2007/0033861 A1 2/2007 Varadaraj et al.
2007/0044373 A1 3/2007 Yao et al.
2007/0056534 A1 3/2007 Verstallen
2007/0059567 A9 3/2007 Varadaraj et al.
2007/0060781 A1 3/2007 Goldman et al.
2007/0083073 A1 4/2007 Bagherzadeh et al.
2007/0119529 A1 5/2007 Hobson et al.
2007/0124989 A1 6/2007 Eickhoff et al.
2007/0124991 A1 6/2007 Reaney et al.
2007/0142481 A1 6/2007 Steynberg et al.
2007/0175088 A1 8/2007 Selkirk
2007/0199238 A1 8/2007 Hooker
2007/0238905 A1 10/2007 Arredondo et al.
2007/0254969 A1 11/2007 Olah et al.
2007/0261293 A1 11/2007 Tajima et al.
2007/0294935 A1 12/2007 Waldron et al.

(56) References Cited

U.S. PATENT DOCUMENTS

2008/0028674 A1 2/2008 Jackson et al.
2008/0060258 A1 3/2008 Rivas et al.
2008/0120898 A1 5/2008 Song et al.
2008/0161588 A1 7/2008 Hassan et al.
2008/0172928 A1 7/2008 Loggers et al.
2008/0178520 A1 7/2008 Church
2008/0207473 A1 8/2008 Startin et al.
2008/0229655 A1 9/2008 Hobson et al.
2008/0233045 A1 9/2008 Ozkan et al.
2008/0250701 A1 10/2008 Van De Berg et al.
2008/0281136 A1 11/2008 Bagherzadeh et al.
2008/0282604 A1 11/2008 Awang et al.
2008/0295389 A1 12/2008 Moncrieff et al.
2008/0305539 A1 12/2008 Hickey et al.
2009/0000131 A1 1/2009 Shafer
2009/0000941 A1 1/2009 Kropf
2009/0000986 A1 1/2009 Hassan et al.
2009/0000989 A1 1/2009 Hassan et al.
2009/0001017 A1 1/2009 Hassan et al.
2009/0001188 A1 1/2009 Hassan et al.
2009/0001316 A1 1/2009 Hassan et al.
2009/0001320 A1 1/2009 Hassan et al.
2009/0003126 A1 1/2009 Hassan et al.
2009/0005521 A1 1/2009 Hassan et al.
2009/0005552 A1 1/2009 Hassan et al.
2009/0005553 A1 1/2009 Hassan et al.
2009/0005578 A1 1/2009 Hassan et al.
2009/0005585 A1 1/2009 Hassan et al.
2009/0005587 A1 1/2009 Hassan et al.
2009/0005588 A1 1/2009 Hassan et al.
2009/0005589 A1 1/2009 Hassan et al.
2009/0005591 A1 1/2009 Hassan et al.
2009/0005592 A1 1/2009 Hassan et al.
2009/0005598 A1 1/2009 Hassan et al.
2009/0005602 A1 1/2009 Hassan et al.
2009/0005604 A1 1/2009 Hassan et al.
2009/0005605 A1 1/2009 Hassan et al.
2009/0005606 A1 1/2009 Hassan et al.
2009/0005608 A1 1/2009 Hassan et al.
2009/0005609 A1 1/2009 Hassan et al.
2009/0005610 A1 1/2009 Hassan et al.
2009/0005611 A1 1/2009 Hassan et al.
2009/0005612 A1 1/2009 Hassan et al.
2009/0005613 A1 1/2009 Hassan et al.
2009/0005615 A1 1/2009 Hassan et al.
2009/0005619 A1 1/2009 Hassan et al.
2009/0005621 A1 1/2009 Hassan et al.
2009/0005622 A1 1/2009 Hassan et al.
2009/0005625 A1 1/2009 Hassan et al.
2009/0009108 A1 1/2009 Hongo
2009/0018286 A1 1/2009 Hassan et al.
2009/0018596 A1 1/2009 Kieval
2009/0024968 A1 1/2009 Yamada
2009/0036694 A1 2/2009 Hassan et al.
2009/0048476 A1 2/2009 Rappas et al.
2009/0049736 A1 2/2009 Suraci et al.
2009/0049737 A1 2/2009 Suraci et al.
2009/0049740 A1 2/2009 Hurst
2009/0084707 A1 4/2009 Gil
2009/0090055 A1 4/2009 Ohtsuka
2009/0090056 A1 4/2009 Ohtsuka
2009/0118380 A1 5/2009 Del Gaudio et al.
2009/0120416 A1 5/2009 Wey
2009/0136392 A1 5/2009 Hassan et al.
2009/0136393 A1 5/2009 Hassan et al.
2009/0136395 A1 5/2009 Hassan et al.
2009/0136396 A1 5/2009 Hassan et al.
2009/0145392 A1 6/2009 Clark et al.
2009/0151231 A1 6/2009 Lee et al.
2009/0152168 A1 6/2009 Siskin et al.
2009/0165361 A1 7/2009 Rappas et al.
2009/0165376 A1 7/2009 Lau et al.
2009/0165379 A1 7/2009 Rappas
2009/0165380 A1 7/2009 Lau et al.
2009/0165381 A1 7/2009 Robinson
2009/0165382 A1 7/2009 Rappas et al.
2009/0165383 A1 7/2009 Rappas et al.
2009/0165384 A1 7/2009 Lau et al.
2009/0166588 A1 7/2009 Spitz et al.
2009/0169448 A1 7/2009 Rappas et al.
2009/0169449 A1 7/2009 Rappas et al.
2009/0170968 A1 7/2009 Nahas et al.
2009/0180940 A1 7/2009 Hassan et al.
2009/0185963 A1 7/2009 Hanson
2009/0188157 A1 7/2009 Holloway, Jr. et al.
2009/0193708 A1 8/2009 Wang
2009/0205245 A1 8/2009 Zhu et al.
2009/0205254 A1 8/2009 Zhu et al.
2009/0208382 A1 8/2009 Hassan et al.
2009/0217575 A1 9/2009 Raman et al.
2009/0217582 A1 9/2009 May et al.
2009/0217584 A1 9/2009 Raman et al.
2009/0217585 A1 9/2009 Raman et al.
2009/0217586 A1 9/2009 Rappas et al.
2009/0217587 A1 9/2009 Raman et al.
2009/0217588 A1 9/2009 Hippo et al.
2009/0217589 A1 9/2009 Robinson
2009/0217590 A1 9/2009 Rappas et al.
2009/0218424 A1 9/2009 Hauserman
2009/0220406 A1 9/2009 Rahman
2009/0229182 A1 9/2009 Raman et al.
2009/0234168 A1 9/2009 Butler et al.
2009/0238750 A1 9/2009 Bosetti et al.
2009/0246120 A1 10/2009 Raman et al.
2009/0247804 A1 10/2009 Sauer et al.
2009/0249682 A1 10/2009 Gunnerman et al.
2009/0250330 A1 10/2009 Gunnerman et al.
2009/0259080 A1 10/2009 Raman et al.
2009/0260278 A1 10/2009 Klausmeier
2009/0260280 A1 10/2009 Klausmeier
2009/0260287 A1 10/2009 Lau
2009/0282729 A1 11/2009 Guzmann et al.
2009/0300969 A1 12/2009 Martin
2009/0313885 A1 12/2009 Wang
2009/0321331 A1 12/2009 Hassan et al.
2009/0324458 A1 12/2009 Robinson et al.
2009/0324459 A1 12/2009 Robinson et al.
2009/0324460 A1 12/2009 Robinson et al.
2009/0324461 A1 12/2009 Robinson et al.
2009/0324462 A1 12/2009 Robinson et al.
2010/0000502 A1 1/2010 Hassan et al.
2010/0004419 A1 1/2010 Hassan et al.
2010/0004493 A1 1/2010 Porter et al.
2010/0015015 A1 1/2010 Hassan et al.
2010/0015019 A1 1/2010 Hassan et al.
2010/0018118 A1 1/2010 Hassan et al.
2010/0028735 A1 2/2010 Basset et al.
2010/0037513 A1 2/2010 Petrucci et al.
2010/0064577 A1 3/2010 Gunnerman et al.
2010/0071262 A1 3/2010 Robinson et al.
2010/0076235 A1 3/2010 Reiling et al.
2010/0080736 A1 4/2010 Hassan et al.
2010/0087688 A1 4/2010 Miller et al.
2010/0088949 A1 4/2010 Reed
2010/0092347 A1 4/2010 Hassan et al.
2010/0092354 A1 4/2010 Hassan et al.
2010/0095580 A1 4/2010 Suzuki
2010/0101978 A1 4/2010 Gordon et al.
2010/0108492 A1 5/2010 Ishmukhametov et al.
2010/0111786 A1 5/2010 Hassan et al.
2010/0114061 A1 5/2010 Hassan et al.
2010/0115828 A1 5/2010 Rehavi et al.
2010/0120926 A1 5/2010 Robinson et al.
2010/0121125 A1 5/2010 Hippo et al.
2010/0122488 A1 5/2010 Fukai
2010/0126059 A1 5/2010 Shiode et al.
2010/0140135 A1 6/2010 Gunnerman et al.
2010/0147764 A1 6/2010 Hassan et al.
2010/0161029 A1 6/2010 Filippini et al.
2010/0168477 A1 7/2010 Hassan et al.
2010/0168494 A1 7/2010 Rappas et al.
2010/0168495 A1 7/2010 Rappas et al.
2010/0170142 A1 7/2010 Posselt et al.
2010/0172939 A1 7/2010 Shaari

(56) References Cited

U.S. PATENT DOCUMENTS

| | | | |
|---|---|---|---|
| 2010/0179232 | A1 | 7/2010 | Robinson et al. |
| 2010/0183486 | A1 | 7/2010 | Hassan et al. |
| 2010/0186288 | A1 | 7/2010 | Ishiguro et al. |
| 2010/0199545 | A1 | 8/2010 | Hassan et al. |
| 2010/0199547 | A1 | 8/2010 | Reed |
| 2010/0200487 | A1 | 8/2010 | Hassan et al. |
| 2010/0212893 | A1 | 8/2010 | Moini Araghi et al. |
| 2010/0217039 | A1 | 8/2010 | Hassan et al. |
| 2010/0222615 | A1 | 9/2010 | Hassan et al. |
| 2010/0236984 | A1 | 9/2010 | Brookhart et al. |
| 2010/0256245 | A1 | 10/2010 | Iaccino et al. |
| 2010/0260649 | A1 | 10/2010 | Jorgensen |
| 2010/0266465 | A1 | 10/2010 | Hassan et al. |
| 2010/0276165 | A1 | 11/2010 | Hobson et al. |
| 2010/0287835 | A1 | 11/2010 | Reiling et al. |
| 2010/0287836 | A1 | 11/2010 | Robinson et al. |
| 2010/0292350 | A1 | 11/2010 | Robinson et al. |
| 2010/0294699 | A1 | 11/2010 | Hassan et al. |
| 2010/0313751 | A1 | 12/2010 | Hassan et al. |
| 2010/0314583 | A1 | 12/2010 | Banerjee |
| 2010/0317748 | A1 | 12/2010 | Hassan et al. |
| 2010/0324308 | A1 | 12/2010 | Hassan et al. |
| 2010/0324349 | A1 | 12/2010 | Gunnerman et al. |
| 2010/0329944 | A1 | 12/2010 | Hassan et al. |
| 2011/0048251 | A1 | 3/2011 | Bardenshtein et al. |
| 2011/0049014 | A1 | 3/2011 | Gunnerman et al. |
| 2011/0056120 | A1 | 3/2011 | Teo |
| 2011/0190565 | A1* | 8/2011 | Novoselov ..... B01J 19/088 585/700 |
| 2012/0088945 | A1 | 4/2012 | Yao et al. |
| 2012/0199795 | A1 | 8/2012 | Gorodetsky et al. |
| 2012/0261391 | A1 | 10/2012 | Ihde et al. |
| 2012/0297665 | A1 | 11/2012 | Goerz, Jr. |
| 2013/0153403 | A1 | 6/2013 | Vancina |

FOREIGN PATENT DOCUMENTS

| | | | |
|---|---|---|---|
| CA | 2385107 | | 4/2001 |
| CA | 2400188 | | 8/2001 |
| CA | 2700126 | | 4/2009 |
| CN | 1590297 | A | 3/2005 |
| CN | 101351679 | A | 1/2009 |
| CN | 101506480 | | 8/2009 |
| CN | 102821841 | A | 12/2012 |
| EP | 984827 | | 3/2000 |
| EP | 1163315 | | 12/2001 |
| EP | 1563041 | | 8/2005 |
| EP | 1754532 | | 2/2007 |
| EP | 2022772 | | 2/2009 |
| FR | 2373328 | | 7/1978 |
| GB | 925089 | A | 5/1963 |
| GB | 2434372 | A | 7/2007 |
| PL | 209944 | B1 | 11/2011 |
| WO | WO-199503374 | | 2/1995 |
| WO | WO-9818884 | | 5/1998 |
| WO | WO-9850139 | | 11/1998 |
| WO | WO-0053699 | | 9/2000 |
| WO | WO-03104173 | | 12/2003 |
| WO | WO03106593 | A1 | 12/2003 |
| WO | WO-2004010454 | | 1/2004 |
| WO | WO-2007083106 | | 7/2007 |
| WO | WO-2008010253 | | 1/2008 |
| WO | WO-20080102532 | | 8/2008 |
| WO | WO-2010069582 | | 6/2010 |
| WO | WO-2010093553 | | 8/2010 |
| WO | WO-2011093736 | | 8/2011 |
| WO | WO-2011119274 | | 9/2011 |
| WO | WO2013134093 | A1 | 9/2013 |

OTHER PUBLICATIONS

Zhang, et al., "Research Advances in Oxidative Desulfurization Technologies for the Production of Low Sulfur Fuel Oils," Petroleum & Coal, vol. 51(3), pp. 196-207 (2009).

Zhao, L. et al., "A Numerical Model of a Wire-Plate Electrostatic Precipitator Under Electrohydrodynamic Flow Conditions," Dept. of Electrical and Computer Engineering, University of Western Ontario, London, Ontario Canada (Jun. 2006). pp. 1-9.

Gogate et al., "Cavitation: A technology on the horizon," Current Science 91:1, 35-46 (2006).

Novoselov et al., "Chain mechanism for initiation of hydrocarbon oxidation reactions in a low-temperature plasma," Letters in Journal of Theoretical Physics 24:19, p. 41 (1998).

"Not Only the Fourth State of Matter but All of Them," Report of the Department of Energy Office of Fusion Energy Sciences, Workshop on Lowe Temperature Plasmas, Mar. 25-27, 2008 (52 pgs.).

Agiral, A., "Electron Driven Chemistry In Microreactors," Thesis, University of Twente, 172 pages, (2009).

Agnew., "Cross-Metathesis of Propane and Methane: A Catalytic Reaction of C_C Bond Cleavage of A Higher Alkane by Methane," Chem. Int. Ed.: 43: 5366-5369 (2004).

Ahmed, W.H. and Basel, I.I., "Innovative Techniques for Two-Phase Flow Measurements," Recent Patents on Electrical Engineering, vol. 1: 1-13 (2008).

Akishev, et al., "Self-Pulsing Regime of DC Electric Discharge in Dielectric Tube Filled With Water Containing Gas Bubble," Plasma Science, IEEE Transactions on , vol. 36, Issue 4, pp. 1142-1143 (2008).

Alcock, W.G. et al., "Chemical Reactions of Methane in a Triboelectric Discharge," Can. J. Chem., vol. 50: 3813-3820 (1972).

Anderson, A.B. and Maloney, J.J. "Activation of Methane on Iron, Nickel, Platinum Surfaces. A Molecular Orbital Study," Case Western Reserve University. pp. 291-298. Publication date unavailable, originally cited in Parent on Apr. 1, 2013.

Anunziata, O.A. and Cussa, J. "Methane Activation Process: Simultaneous Optimization of Methan Conversion and Aromatic Yeilds using Zn-XSM-11 Zeolite," The Open Process Chemistry Journal, vol. 3:7-16 (2010).

Babaeva, N.Y. and Kushner, M.J., "Branching and Structure of Streamers in Gases, Liquids and Gaseous Bubbles Immersed in Liquids," Department of Electrical Engineering & Computer Science, University of Michigan; Downloaded from http://uigelz.eecs.umich.edu/Projects/STREAMERS/Natalie_streamer_project_v02.html on Dec. 12, 2014;Last Updated Jun. 12, 2009 (3 pgs.).

Basset, J-M, "From Material Science to Single Site Catalysis," University of Lyon, France KFUPM-KAUST Workshop May 5-6, 2009; KFUPM Dhahran, Saudi Arabia. Abstract only. 1 page.

Basset, J.M., "Direct Conversion of Ethylene to Propylene," www.kufpm.edu.sa/catsymp/symp%2019th/PAPERS/19Basset.doc; King Abdullah University of Science and Technology; Thuwal, Saudi Arabia and Universty of Lyon (1918) 1 page.

Becker, et al., "Plasma-Assisted Reformin and Hydro-Desulfurization of Diesel Fuels for Fuel Cells," Polytech Institute of NYU, 18 pages (undated).

Boodhoo, K., "Intensification of gas-liquid mass transfer using porous impellers for application to an *E.coli* batch fermentation process," PIN Meeting, Nov. 16, 2006 (20 pgs.).

Boumans, A.A., "Streaming currents in turbulent flows and metal capillaries. III. Experiment (1). Aim and procedure," Physica, vol. 23, Issue 6-10, pp. 1038-1046 (1957).

Bowman, C.T. et al., "Optimization of Synthetic Oxygenated Fuels for Diesel Engines Investigators," GCEP Technical Report 2006. pp. 1-10.

Burak, S.R. "Homogenization—Improving Heavy Fuel Oil Usage by Homogenization," Ashland Specialty Chemical Company Drew Marine Division; Publication date unavailable, originally cited in Parent on Apr. 1, 2013 9 pages.

Caldwell, T.A. et al., "Third Body Enhanced Methane Conversion in a Dielectric-Barrier Discharge Reactor"; University of Oklahoma. pp. 490-495. Publication date unavailable, originally cited in Parent on Apr. 1, 2013.

Ceccato, Paul, "Filamentary plasma discharge inside water: initiation and propagation of a plasma in a dense medium," Thesis (Dec. 16, 2009).

(56) References Cited

OTHER PUBLICATIONS

Chang, et al., "EHD Surface Waves of Diesel Oil Thin Films Generated by Wire-Plate Barrier Discharges," http://laboratorios.fi.uba.ar/lfd/web%20publi/chang.pdf.
Choudhary, et al., "Low-Temperature Nonoxidative Activation of Methane over H-Galloaluminosilicate (MFI) Zeolite," Science, vol. 275, No. 5304, pp. 1286-1288 (Feb. 28, 1997).
Conde, et al., "Frequency Effects in The Catalytic Oligomerization Of Methane Via Microwave Heating," Fuel Chemistry Division Preprints 2002, vol. 47, No. 1, pp. 272-277 (2002).
Environmental Effects EPA Chapter 1 External Combustion Sources, AP 42, Fifth Edition, vol. I; Chapter 1: External Combustion Sources: http://www.epa.gov.ttnchie1/ap42/ch01/. 12 pages.
Extended European Search Report issued by the European Patent Office for European Patent Application No. 15151831.3 dated Mar. 30, 2015 (11 pages).
Fayyad, S. et al., "Emulsfied Diesel Fuels in Engines: Experimental Emulsified Diesel and Benzen Investigation," Res. J. Appl. Sciences, Eng. Tech., vol. 2(3): 268-273 (2010).
Feng, Z. and Anthony, R.G. "Reactions of Propane on Hydrous Metal Oxide-Supported Catalysts," Texas A&M University. pp. 1826-1832. Publication date unavailable, originally cited in Parent on Apr. 1, 2013.
Fernando, S. and Hanna, M. "Phase Behavior of the Ethanolbiodiesel Diesel MicroEmulsion System," Transactions of the ASABE, vol. 48(3): 903-908 (2005).
Fir Fuel Activator—Infrared Aldi Far-IR Products Slides; www.gefir.com/FIR_Fuel_Activator-71124.pps.
Fu, G. et al., Mechanisms of Methane Activation and Transformation on Molybdenum Oxide Based Catalysts, J. Am. Chem., VI. 127(11): 3989-3996 (2005).
Fung, R. "The Upgrading of Heavy Oil Model Compounds Using Methane Activated by Metal Oxides Encapsulated in Molecular Sieves," A Thesis submitted in conformity with the requirements for the degree of Master of Applied Science, Graduate Department of Chemical Engineering, University of Toronto (1999). 139 pages.
CN Office Action; dated Aug. 2, 2018 for CN Application No. CN201580073715.2.
European Search Report; dated Jun. 13, 2018 for EP Application No. 15864470.8.
Nozaki, Tomohiro, and Ken Okazaki. "Non-thermal plasma catalysis of methane: Principles, energy efficiency, and applications." Catalysis today 211 (2013): 29-38.
Aleknaviciute, Irma. Plasma assisted decomposition of methane and propane and cracking of liquid hexadecane. Diss. Brunel University School of Engineering and Design PhD Theses, 2014.
Goers, Jr., David J., "Combined Oxidative, Methanated and Hyrotreated Fuel Reaction Disclosure," dated Mar. 12, 2013 (1 pg.).
GreatPoint Energy Website, "Our Technology," Downloaded from http://www.greatpointenergy.com/ourtechnology.php on Dec. 12, 2014 (2 pgs.).
Guczi, et al., "Low-Temperature Coupling of Methane," Catal. Rev.-Sci. Eng., vol. 38, No. 2, pp. 249-296 (1996).
Harteck and Donde, "Reaction of Carbon Monoxide and Ozone," J. Chem. Phy., vol. 26: 1734 (4 pages) (1957).
Harteck, P. and Dondes, S., "Reaction of Carbon Monoxide and Ozone," J. Chem. Phys., vol. 26, 1734 (1957).
Hong, et al., "Plasma Technology in Heavy Oil Processing," <www.paper.edu.cn/index.php/default/releasepaper/paper_all/4409783> Publication date unavailable, originally cited in Parent on Dec. 16, 2014.
Hong, K-S, et al., "Direct Water Splitting Through Vibrating Piezoelectric Microfibers in Water," J. Phys. Chem. Lett, vol. 1(6): 997-1002 (2010).
Johansen, T. & Schramm, J. et al., "Low-Temperature Miscibility of Ethanol-Gasoline-Water Blends in Flex Fuel Applications" International Combustion Engines Group, Dept. of Mechanical Engineering, Technial University of Denmar, Kgs. Lyngsby, Denmark. Energy Sources, Part A, 31: 1634-1645. 2009.
Kado, et al., "Diagnosis of atmospheric pressure low temperature plasma and application to high efficient methane conversion" Catalysis Today, vol. 89, pp. 47-55 (2004).
Kado, et al., Reaction mechanism of methane activation using non-equilibrium pulsed discharge at room temperature, vol. 82, Issue 18, Dec. 1, 2003, pp. 2291-2297.
Kamimura, H. et al., "Upgrading of Bitumen with Supercritical Water for A System Combined with SAGD," Tohoku University, Japan, pp. 742-745. Publication date unavailable, originally cited in Parent on Apr. 1, 2013.
Kaneko, et al., "Static gas-liquid interfacial direct current discharge plasmas using ionic liquid cathode," J. Appl. Phys., vol. 105, 103306-103306-5 (2009).
Karimi, A. et al., "Catalytic Oxidative Coupling of Methane-Experimental Investigation and Optimization of Operational Conditions," Petroleum & Coal, vol. 49(3): 36-40 (2007).
Kesling, H.S. et al., "Oxygenated Microemulsion Diesel Fuel," ARCO Chem. Co. pp. 322-326, publication date unavailable, originally cited in parent on Apr. 1, 2013.
Knothe, G. and Dunn, R.O., "Dependence of Oil Stability Index of Fatty Compounds on Their Structure and Concentration and Presence of Metals," JAOCS, vol. 80(10), 2003. pp. 1021-1026.
Kong, et al., "Plasma Processing of Hydrocarbon, Electric Power 2007," Idaho National Laboratory, May 2007 (12 pgs.).
Kong, et al., "Reactive Plasma Upgrade of Squalane—A Heavy Oil Simulant," International Symposium On Plasma Chemistry, vol. 2, pp. 607-612 (1996).
Kozlov, et al., "Synthesis of organic compounds from mixtures of methane with carbon dioxide in dielectric barrier discharge at atmospheric pressure," Plasmas and Polymers, vol. 5, No. 3/4, pp. 129-150 (2000).
Lane, Jim, "Anellotech and the advent of the Green 'Enes," Downloaded from http://www.biofuelsdigest.com/bdigest/2013/03/10/anellotech-and-the-advent-of-the-green-enes/ on Mar. 10, 2013 (3 pgs.).
Larkin, D.W. et al., "Oxygen Pathways and Carbon Dioxide Utilization in Methane Partial Oxidization in Ambient Temperature Electric Discharges,", Energy & Fuels, vol. 12: 740-744 (1998).
Larkin, D.W. et al., "Production of Organic Oxygenates in the Partial Oxidation of Methane in a Silent Electric Discharge Reactor," Ind. Eng. Chem. Res., vol. 40: 1594-1601: 40 (2001).
Leite, L.F. et al., Survey of Microwave Technology Potential Application in Heavy Crude Oil Upgrading, 2nd Mercosur Congress on Chemical Engineering and 4th Mercosur Congress on Process Systems Engineering. 11 pages. Publication date unavailable, originally cited in Parent on Apr. 1, 2013.
Lif, A. and Holmberg, K, "Water-in-diesel emulsions and related systems," Advances in Colloid and Interface Science, 1233-126 (2006) pp. 231-239.
Linde, N. et al., "Streaming current generation in two-phase flow conditions," Geophysical Research Letters, vol. 34: L03306 (Jan. 10, 2007). 8 pages.
Liu, C. et al., "Methane Conversion to Higher Hydrocarbons in a Corona Discharge over Metal Oxide Catalysts with OH Groups," Appl. Catalysis, General 164: 21-33 (1997).
Liu, et al., "Catalytic Oxidative Desulfurization of a Model Diesel," Thesis, Louisiana State University and Agricultural and Mechanical College, Aug. 2010 (76 pgs.).
Liu, et al., "Kinetics and Mechanism of Plasma Oxidative Desulfurization in Liquid Phase," Energy & Fuels, vol. 15, pp. 38-43 (2001).
Loviat, F. "Photoassisted Activation of Methane Over Supported Catalysts with a Xenon Excimer Lamp," A dissertation submitted to Eth Zurich, Dissertation Eth No. 18145 (2009). 179 pages.
Maroni, P. "Bond and Mode Specific Reactivity of Methane on Ni(100)," Thesis No. 3335 (2005). 191 pages.
Mohammad, A.A. et al., "Experimental Investigation of in situ Upgrading of Heavy Oll by Using a Hydrogen Donor and Catalyst During Steam Injection," Aug. 2008 (199 pages).
Mohammedi, et al., "desulfurization study of hydrocarbon molecules by plasma process for gasoil applications," (2005) Downloaded from https://web.anl.gov/PCS/acsfuel/preprint%20archive/Files/41_1_NEW%20ORLEANS_03-96_0503.pdf on Dec. 12, 2014, pp. 503-509.

(56) References Cited

OTHER PUBLICATIONS

Murphy, et al., "Functionalization and fragmentation during ambient organic aerosol aging: application of the 2-D volatility basis set to field studies," Atmos. Chem. Phys., vol. 12, pp. 10797-10816 (2012).
Ng, F.T.T. "Upgrading Heavy Oilbitumen Emulsions Via in situ Hydrogen Generation," Publication date unavailable, originally cited in Parent on Apr. 1, 2013 (5 pages).
Ohyama, R. et al., "Electrical Current Condition and Electrohydrodynamically induced fluid flow in an AW type EHD pump," J. of Electrostatics vol. 53(2) Aug. 2001, pp. 147-158.
Okajima, S. et al., "Discovery of Principle on Combustion Promotion by a Specific Wave Number at the Regime of Far Infrared Ray—The Challenge to Realization of High Energy Saving and Low Emission of Co2," http://www.combustion.org.uk/ECM_2009/P810032.pdf. 2009 (5 pages).
Zongxuan, et al., "Oxidative Desulfurization of Fuel Oils," Chin. J. Catal., vol. 32, pp. 707-715 (2011).
Ovalles, C. et al., "Upgrading of Extra-Heavy Crude Oil by Direct Use of Methane in the Presence of Water—Deuterium-Labelled Experiments and Mechanistic Considerations," Fuel 1995. vol. 74, No. 8. pp. 1162-1168.
Ovalles, C. et al., Upgrading of Extra-Heavy Crude Using Hydrogen Donor Under Steam Injection Conditions, Characterization by Pyrolysis GC-MS of the Asphaltenes and Effect of a Radical Initiator (Key Paper); Fuel Chem. Div. Preprints. 2003, 48(1), pp. 59-60.
Ovalles, C. et al., "Use of a Dispersed Iron Catalyst for Upgrading Extra-Heavy Crude Oil Methane as Source of Hydrogen," Universidad Central de Venezuela, Apdo. 47 102, Caracas 1040A, Venezuela. Fernando Gonzales-Giminez, B. Pierre Embaid, Depto. de Fisica, Ciencas, UCV, Apdo. 47586, Caracas 1041A, Venezuela. pp. 521-525. Publication date unavailable, originally cited in Parent on Apr. 1, 2013.
Park, et al., "Electrostatic charging phenomenon in gas-liquid-solid flow systems," Chem. Eng. Sci. 62 (2007, pp. 371-386.
Park, et al., "Electrostatic charging phenomenon in gas-liquid-solid flow systems," vol. 62, Issues 1-2, Jan. 2007, pp. 371-386.
Park, et al., "Micro Bubble Formation on sub-mm Tip Electrode Discharge in the Electrolyte Solution," Downloaded from http://www.ispc-conference.org/ispcproc/papers/647.pdf on Dec. 12, 2014 (4 pgs.).
Pawelec, et al., "Towards near zero-sulfur liquid fuels: a perspective review," Catal. Sci. Technol., vol. 1, pp. 23-42 (2011); Retraction published Dec. 3, 2012.
Plasma Science: Advancing Knowledge in the National Interest, Plasma 2010 Committee, Plasma Science Committee, National Research Council, ISBN: 0-309-10944-2, 280 pages, 7×10, (2007) (281 pgs.).
Pushkarev, et al., "Methane conversion in low-temperature plasma," High Energy Chemistry (Impact Factor: 0.64), vol. 43, No. 3, pp. 156-162 (Jan. 2009).
Rahimi, P., et al., "The Use of Methane as Source of Higher Hydrocarbons and Hydrogen for Upgrading Heavy Oils and Bitumen," http://www.anl.gov/PCS/acsfueld/preprint%20archive/Files/43_3_Boston_08-98_0476.pdf. pp. 476-480. Publication date unavailable, originally cited in Parent on Apr. 1, 2013.
Rahimi, P.M. and Gentzis, T. The Chemistry of Bitumen and Heavy Oil Processing, National Centre for Upgrading Technology, Alberta, Canada; <http://chentserver.uwaterloo.ca/aelkamel/che720/che735/lectures_che735_students/new-boo-practical-advances-refinery/chapter19-bitumen-and-heavy-oil-processing.pdf> Publication date unavailable, originally cited in Parent on Dec. 16, 2014.
Reppert, P.M. et al., "Frequency-Dependent Streaming Potentials," J. of Colloid and Interface Science, vol. 234: 194-203 (2001).
Roy, R. "The Structure of Liquid Water; Novel Insights from Materials Research; Potential Relevance to Homeopath," Materials Research Innovations Online. Sep. 2005. pp. 577-608.
Sarnobat, et al., "The impact of external electrostatic fields on gas-liquid bubbling dynamics," vol. 59, Issue 1, pp. 247-258 (Jan. 2004).
Sasaki, T. et al., "Process Developments of Natural Gas Conversion Technology to Liquid Fuels Via OCM Reaciton New" <http://www.anl.gov.PCS/acsfuel/preprint%20archive/Files/40_1_anaheim_04-95_0105.pdf> pp. 105-109. Publication date unavailable, originally cited in Parent on Apr. 1, 2013.
Schellekens, et al., "Enhancements in the well to wheel path of natural gas," MDP Final Report, Nov. 2007 (68 pgs.).
Search Report issued by the Polish Patent Office in Corresponding Polish Application No. P-406629 dated Apr. 29, 2004 (2 total pgs.—including translation).
Sprunt, et al., "Streaming potential from multiphase flow," Geophysics, May 1994, V. 59, pp. 707-711, published online May 1, 1994.
Sreethawong, T. et al., "Partial Oxidation of Methane with Air for Synthesis Gas Production in a Multistage Gliding Arc Discharge System", Chulalongkorn University; Available online Sep. 12, 2006. Int'l. J. Hydrogen Energy, 32 (2007). pp. 1067-1079.
Tachibana, K., "Microplasma generation in artificial media and its potential applications," Pure Appl. Chem., vol. 82, No. 6, pp. 1189-1199 (2010).
Thagard, et al., "The Production of Hydrogen and Olefin Hydrocarbons by Electrical Discharge in Liquid Fuels," Poster Session 1 (2009); Downloaded from http://www.electrostaticanswers.com/2009ESJC/Poster1/2009%20Mededovic%20Production%20of%20Hydrogen%20and%20Olefin%20Hyddrocarbons.pdf on Dec. 12, 2014 (6 pgs.).
Urashima, K. and Chang, J. S., "Removal of volatile compounds from air streams and industrial flue gases by non-thermal plasma technology" IEEE Transactions on Dielectrics and Electrical Engineering, vol. 7, No. 5, pp. 602-614 (2000).
Wey, A.C. et al., "Infrared-Excitation for Improved Hydrocarbon Fuel's Combustion Efficiency," 7APAC-45. 2007, pp. 1-8.
Xia, et al., "Removal of ammonia from gas streams with dielectric barrier discharge plasmas" vol. 152, Issue 1, pp. 113-119 (2008).

* cited by examiner

DIRECT INCORPORATION OF NATURAL GAS INTO HYDROCARBON LIQUID FUELS

BACKGROUND OF THE INVENTION

1. Field of the Invention

The present invention is directed to the field of incorporating gaseous hydrocarbons into a liquid fuel. In particular, the present invention is directed to a process of using non-thermal plasma to activate gaseous hydrocarbons to incorporate them into a liquid fuel.

2. Description of the Related Technology

Recent development of shale gas in the United States has provided an abundant supply of natural gas. This increased supply has led to a dramatic drop in the price of natural gas. Crude oil and other liquid fuels have been selling for substantial premiums in comparison to natural gas, with prices for crude oil trading approximately 70% higher and diesel approximately 80% higher on an energy equivalent basis. In other words, the cost of natural gas for generating the same amount of energy from one barrel of crude oil is very significantly lower than the price of crude oil.

In addition, an enormous amount of natural gas has been wasted by the practice of flaring in the petroleum industry whereby the natural gas from an oil well is simply burnt. The World Bank estimates that in excess of 140 billion cubic meters of natural gas was flared in 2011 alone, polluting the atmosphere and wasting approximately $50 billion worth of natural gas. There is an increasing international pressure to end the practice of flaring. One solution used by the petroleum industry is re-injecting these massive quantities of natural gas back into oil wells in lieu of flaring, albeit at a substantial additional cost that does not offer a substantial benefit to the company. Large energy companies are actively looking for better ways to convert the natural gas from oil wells to liquid fuels that are more stable and easier to transport.

The traditional technology used to convert natural gas into high-value oils and "drop-in" fuels involves converting methane to syngas followed by Fischer-Tropsch synthesis (FTS). This technology is extremely capital intensive. The technology uses a multi-stage process to break methane molecules apart into carbon and hydrogen, then rebuilds synthetic oil molecules from the carbon and hydrogen, and finally refines the synthetic oil into finished "drop-in" synthetic fuels. The synthetic oils are made entirely of converted methane molecules. Because this process is capital intensive, it is economically viable only at massive scales with abundant supplies of nearby cheap natural gas.

US 2012/0297665 discloses a process for making a hybrid fuel by combining a light gas and a liquid fuel. The process includes the steps of introducing into a reactor a reactant that comprises one or more light gases, exposing the first reactant to non-thermal plasma under conditions sufficient to reform the first reactant to generate syngas, free radicals and energetic electrons, introducing a liquid fuel to the reactor, and intimately contacting the reaction products to non-thermal plasma and in contact with the liquid fuel in the reactor to produce a hybrid fuel. The light gas may include, for example, carbon dioxide and hydrocarbons such as methane, ethane, propane, ethanol and methanol.

US 2011/0190565 discloses a process for converting a gaseous hydrocarbon to liquid fuel by introducing the gaseous hydrocarbon into a reactor with a trough and a discharge region bordered by electrodes, introducing to the trough a liquid sorbent and generating a non-thermal, repetitively pulsed gliding arc discharge in the discharge region thereby producing a liquid hydrocarbon fuel. The liquid sorbent may be gasoline, diesel fuel, kerosene, a liquid alkane, or a combination thereof.

US 2009/0205254 discloses a method for converting methane gas to liquid fuel using non-thermal plasma. The method includes the steps of providing a reactor having a reaction chamber, providing a flow of methane gas and a flow of a reactant gas into the reaction chamber, providing a catalyst in the reaction chamber, producing a non-thermal plasma in the reaction chamber to convert the methane gas and the reactant gas into radicals, and directing the radicals over the catalyst to couple the radicals into hydrocarbons in liquid form. The reactant gas may include, for example, $CO_2$, $O_2$ and $H_2O$.

U.S. Pat. No. 6,896,854 discloses both a system and a method for reactive co-conversion of heavy hydrocarbons such as heavy crude oil and hydrocarbon gases such as natural gas to lighter hydrocarbon materials such as synthetic light crude oil. The method relies on the use of dielectric barrier discharge plasma that causes simultaneous addition of carbon and hydrogen to heavy oil in a single step. The system includes a reactor with a dielectric barrier discharge plasma cell having a pair of electrodes separated by a dielectric material and a passageway there between. A packed bed catalyst may optionally be used in the reactor to increase the efficiency of conversion.

These known processes use very strong electrical fields and high electron energies to break gaseous hydrocarbons such as methane in order to produce reactive radicals such as $CH_3$. or syngas for reacting with each other or heavy hydrocarbons. As a result, these processes require a large amount of energy. The energy requirements of these processes make these processes economically unattractive when conducted on a small scale. There is a clear market need for a scalable process that requires a low capital expenditure and has a relatively low operating cost for efficient conversion of the abundantly available natural gas into high-value liquid fuels.

The present invention employs a relatively weak electrical field to generate non-thermal plasma in order to activate gaseous hydrocarbons such as methane into a reactive state without cleaving the bonds of the gaseous hydrocarbon molecules. The activated gaseous hydrocarbons are able to react with the longer chain hydrocarbons in a liquid fuel thereby incorporating components of the natural gas into liquid fuels.

SUMMARY OF THE INVENTION

In one aspect, the present invention provides a method of incorporating a gaseous hydrocarbon into a liquid hydrocarbon, comprising steps of exposing a gaseous hydrocarbon to non-thermal plasma generated using an electric field with an E/N ratio in a range of from about 10 to about 30 Td to provide an activated gaseous hydrocarbon, and contacting the activated gaseous hydrocarbon with a liquid hydrocarbon.

In another aspect, the electric field of the present invention is generated by a discharge selected from a gliding arc discharge, a microwave discharge, a corona discharge, an atmospheric pressure glow discharge and a dielectric barrier discharge.

BRIEF DESCRIPTION OF THE DRAWINGS

The patent or application file contains at least one drawing executed in color. Copies of this patent or patent application publication with color drawings will be provided by the Office upon request and payment of the necessary fee.

DETAILED DESCRIPTION OF THE PREFERRED EMBODIMENT(S)

For illustrative purposes, the principles of the present disclosure are described by referencing various exemplary embodiments. Although certain embodiments are specifically described herein, one of ordinary skill in the art will readily recognize that the same principles are equally applicable to, and can be employed in other systems and methods. Before explaining the disclosed embodiments of the present disclosure in detail, it is to be understood that the disclosure is not limited in its application to the details of any particular embodiment shown. Additionally, the terminology used herein is for the purpose of description and not of limitation. Furthermore, although certain methods are described with reference to steps that are presented herein in a certain order, in many instances, these steps may be performed in any order as may be appreciated by one skilled in the art; the novel method is therefore not limited to the particular arrangement of steps disclosed herein.

It must be noted that as used herein and in the appended claims, the singular forms "a", "an", and "the" include plural references unless the context clearly dictates otherwise. Furthermore, the terms "a" (or "an"), "one or more" and "at least one" can be used interchangeably herein. The terms "comprising", "including", "having" and "constructed from" can also be used interchangeably.

Figure 7:
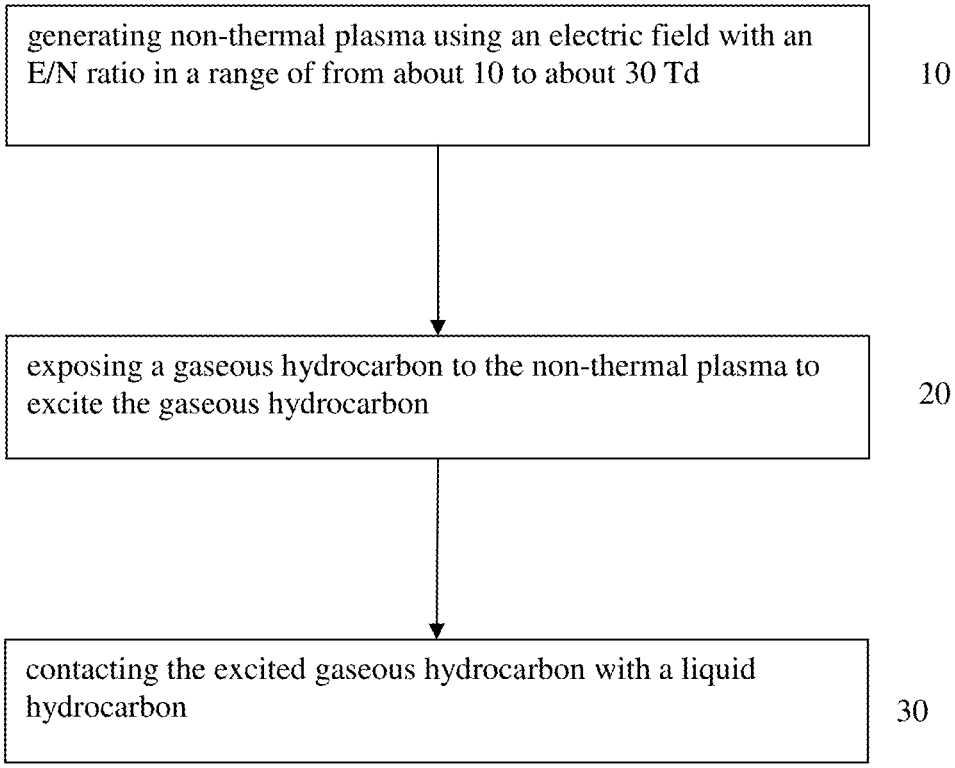
FIG. 7 is a flow chart representing one embodiment of the present invention for incorporating a gaseous hydrocarbon into a liquid fuel.

The present invention provides a method for incorporating one or more gaseous hydrocarbons such as methane into liquid hydrocarbons, preferably of a liquid fuel or for the purpose of forming a liquid fuel. Referring to FIG. 7, the method comprises the steps of generating 10 non-thermal plasma using an electric field with an E/N ratio in a range of from about 10 to about 30 Td, exposing 20 one or more gaseous hydrocarbons to the non-thermal plasma to activate the gaseous hydrocarbons, and contacting 30 the activated gaseous hydrocarbons with one or more liquid hydrocarbons to provide a liquid fuel. Activated gaseous hydrocarbons will react with liquid hydrocarbons and thereby be incorporated into the liquid hydrocarbons in order to form part of the liquid fuel. The E/N ratio is a measurement of a reduced electric field, where E is the electric field in V/cm and N is a concentration or number density of neutral particles (e.g., gas particle density in the electric field). The E/N value is independent of the pressure in a chamber where the non-thermal plasma is being generated. E/N ratio 10-30 Td correspond to electron energy in the range 0.2-2 eV (to be measured spectroscopically).

The present invention uses non-thermal plasma to activate the gaseous hydrocarbons. As used herein "plasma" refers to an ionized gas, into which sufficient energy is provided to free electrons from atoms or molecules and to allow both ions and electrons to coexist. As used herein, the term "non-thermal plasma," or "non-equilibrium plasma," or "cold plasma," refers to plasma that is not in a state of thermodynamic equilibrium. While the electrons in non-thermal plasma have high electron temperatures, the temperature of the other atoms and molecules in the plasma are relatively low, hence the system is not in thermodynamic equilibrium.

In comparison to non-thermal plasma, thermal plasma, or "hot plasma," is produced as a result of strong gas heating in a gas discharge to a temperature of several thousand Kelvin, and, as a result, the energy distribution of the gas molecules, ions and electrons in the thermal plasma is in thermodynamic equilibrium. The resulting large number of collisions between particles, in particular between electrons and heavy positive ions or neutral particles, leads to rapid redistribution of energy so that thermodynamic equilibrium is reached.

Figure 1:
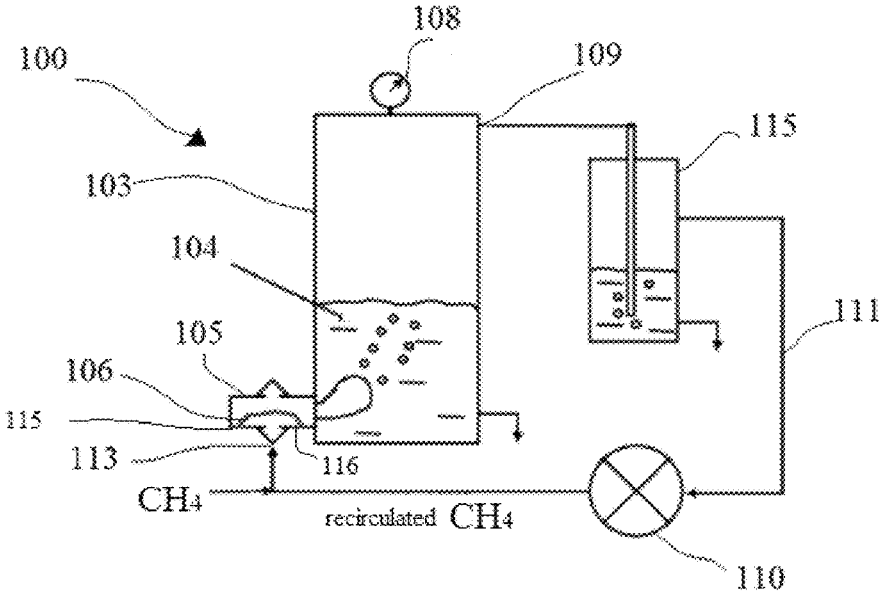
FIG. 1 depicts an embodiment of the present invention that employs a gliding arc discharge to generate the non-thermal plasma and which is equipped with methane recycle.

Referring to FIG. 1, in one embodiment, the non-thermal plasma may be generated by a reduced electric field having an E/N RATIO in the range of from about 10 to about 30 Td. Non-thermal plasma generated in this manner produces a significant amount of vibrational-translational non-equilibrium at atmospheric pressure. The degree of vibrational-translational non-equilibrium may be measured experimentally (spectroscopically). In some embodiments, the reduced electric field may have an E/N RATIO in a range of from about 12 to about 28 Td, or from about 14 to about 26 Td, or from about 14 to about 24 Td, or from about 16 to about 22 Td, or from about 18 to about 20 Td. The reduced electric field of the present invention typically generates an electron energy in a range of from about 0.2 eV to about 2 eV, or from about 0.4 eV to about 1.8 eV, or from about 0.6 eV to about 1.6 eV, or from about 0.6 eV to about 1.4 eV, or from about 0.8 eV to about 1.2 eV, or from about 0.9 eV to about 1.2 eV, or from about 0.9 eV to about 1.1 eV.

Such non-thermal plasma can be generated in several different ways, including, at least, by a high gas flow gliding arc discharge, a microwave discharge, a corona discharge, an atmospheric pressure glow discharge, and a dielectric barrier discharge.

Referring to FIG. 7, in the step of exposing 20, the gaseous hydrocarbons are exposed to the non-thermal plasma and are thereby activated into a reactive state. The non-thermal plasma generated by the reduced electric field of the present invention activates the gaseous hydrocarbon molecules, but does not provide sufficient energy to break chemical bonds in the gaseous hydrocarbon molecules to produce radicals or syngas, as is the case in many prior art processes. In some embodiments, the gaseous hydrocarbons enter the non-thermal plasma at a very low pressure, close to vacuum and in some embodiments pressure could be higher than atmospheric. The pressure range is from about 0.1 to about 3 atm, or from about 0.1 to about 3 atm, or from about 0.1 to about 3 atm, or from about 0.3 to about 2.7 atm, or from about 0.5 to about 2.5 atm, or from about 0.7 to about 2.2 atm, or from about 0.8 to about 2 atm, or from about 0.8 to about 1.5 atm.

Without being bound by theory, it is believed that the gaseous hydrocarbon molecules, after contacting the non-thermal plasma, are activated both vibrationally and translationally. This excitation is not sufficient to break the chemical bonds (C—C or C—H) of the gaseous hydrocarbon molecules, since typically this would require a reduced electric field having an E/N ratio in the range of 100-200 Td. Instead, the activated gaseous hydrocarbon molecules react with the liquid hydrocarbon molecules without having any bonds broken and are incorporated into the liquid hydrocarbon molecules and become part of the produced liquid fuel. In some embodiments, the gaseous hydrocarbon is methane. The activated methane has a vibrational temperature of about 2000-4000K, while the gas temperature is not higher than 700-1100K.

As used herein, the term "gaseous hydrocarbon" refers to light hydrocarbon materials that exist in the gaseous state at 22 degrees Celsius and 1 atmosphere pressure. The light hydrocarbon materials are typically low order hydrocarbons having from one to four carbon atoms. For example, such light hydrocarbon materials may include, but are not limited to, methane, ethane, propane, n-butane, iso-butane, and tert-butane, or a mixture of any two or more such compounds. In some embodiments, the light hydrocarbons may be those that are associated with natural gas or gas obtained from oil production, or the light hydrocarbons may be produced as a result of land-fill operations, or other natural gas deposits or natural gas generation.

In some embodiments, the gaseous hydrocarbons may be present in a composition that also contains an inert gas such as carbon dioxide or nitrogen. Such a mixture may be exposed to the non-thermal plasma in which case only the gaseous hydrocarbons are activated, while the inert gases remain inert and thus do not participate in the chemical reactions forming the liquid fuels.

In one preferred embodiment, the gaseous hydrocarbon is methane. The methane can be in the form of pure methane gas. Alternately, the methane gas can be a component of natural gas obtained from a "fossil fuel" deposit, which typically consists of about 90% or more of methane, along with small amounts of ethane, propane, and "inerts" like carbon dioxide and nitrogen. As another alternative, the methane gas can be in the form of a bio-gas derived from organic material, such as organic waste. In some embodiments, the methane gas can be supplied from a tank (or a pipeline) at temperature range 22-300° C.) and at pressure range 1-3 atm.

Referring to FIG. 7, in the step of contacting 30 the one or more activated gaseous hydrocarbons with the one or more liquid hydrocarbons, the activated gaseous hydrocarbon reacts with the liquid hydrocarbon and, as a result, are incorporated into the liquid hydrocarbon and become part of the liquid fuel. Without being bound by theory, it is believed that the activated gaseous hydrocarbon molecules, using methane as an example, follow an exothermic plasma catalytic incorporation process as set forth below:

$$CH_4^*+RH \rightarrow CH_3R(H)H,$$

$$CH_4^*+ROH \rightarrow RCH_3+H_2O,$$

$$CH_4^*+R_1{=}R_2H \rightarrow CH_3R_1R_2H,$$

$$CH_4^*+Armt \rightarrow CH_3RH$$

Here $CH_4^*$ is activated molecule of methane; RH—general formula of hydrocarbons; Armt—aromatic hydrocarbons.

These reactions proceed with a low energy cost relative to prior art methods that involve breaking chemical bonds in the methane molecules. R represents any hydrocarbyl group of a liquid hydrocarbon. Another incorporation process that may occur in the present invention may proceed by a first step of combining the activated gaseous methane molecules to form dimers, trimers or higher polymers (ethane, propane etc.) followed by incorporation of these dimers, trimmers or higher polymers into the liquid hydrocarbons.

As used herein, the term "liquid hydrocarbon" includes wide variety hydrocarbons found in liquid fuels having R groups of $C_5$ to $C_{28}$, or up to $C_{25}$, or up to $C_{20}$. Such liquid hydrocarbons include, but are not limited to, $C_5$ to $C_{28}$ alkanes, alkenes, alkynes, their isomeric forms, and mixtures of any two or more such compounds. Mixtures of the liquid hydrocarbons may be found, for example, in crude oil, gasoline, diesel fuel, kerosene fuels, hydrocarbon waxes, and hydrocarbon oils.

The liquid hydrocarbons are typically components of a liquid fuel. As used herein, the term "liquid fuel" refers to any hydrocarbon-based fuels that are in a liquid form at 22° C. As used herein, the term "hydrocarbon-based" means that the liquid fuel has a predominantly hydrocarbon character within the context of this invention. These include groups that are purely hydrocarbon in nature, that is, they contain only carbon and hydrogen. They may also include groups containing substituents or atoms which do not alter the predominantly hydrocarbon character of the group. Such substituents may include halo-, alkoxy-, nitro-, hydroxyl, etc. These groups also may contain hetero atoms. Suitable hetero atoms will be apparent to those skilled in the art and include, for example, sulfur, nitrogen and oxygen. Therefore, while remaining predominantly hydrocarbon in character within the context of this invention, these groups may contain atoms other than carbon present in a chain or ring otherwise composed of carbon atoms.

Examples of liquid fuels that are suitable for use in the present invention include, organic and hydrocarbon materials such as gasoline, kerosene, naphtha, gas oils, heating oils, diesel oils, fuel oils, residual oils, and other petroleum products manufactured from crude petroleum, including heavy oil, by separation and/or reaction processes, such as distillation and cracking, which separate the petroleum into various fractions with different molecular weights. In some embodiments, liquid fuels may be lower grade liquid fuels and synthetic fuels derived from coal, shale oil, bituminous sands, tar sands, and the like by various liquefaction processes. The liquid fuels may also be liquid alkanes, liquid alkenes, or liquid alkynes. "Drop-in" fuels may also be used.

In some embodiments, in the contacting step 20, in order to create more contact between the gaseous hydrocarbons and the liquid hydrocarbons in order to facilitate the incorporation reaction, the liquid fuel may be introduced in the form of small droplets or may be atomized to an average diameter in a range of from about 1 microns to about 30 microns, or from about 3 microns to about 27 microns, or from about 5 microns to about 25 microns, or from about 7 microns to about 23 microns, or from about 10 microns to about 20 microns, or from about 12 microns to about 18 microns. The use of small droplets of liquid fuel can ensure that the liquid hydrocarbons have a very large contact surface to facilitate incorporation of the gaseous hydrocarbons into the liquid hydrocarbons. In some embodiments, the liquid fuel may be introduced as vapor.

In one embodiment, the liquid fuel can be sprayed as a mist of small droplets by any suitable device known to a person skilled in the art. For example, pneumatic nozzles or atomizers may be used to provide droplets of a desired range of diameters. Accordingly, in this embodiment, the liquid fuel may comprise any or all of the liquid hydrocarbons discussed above, alone or in combinations, provided that the liquid fuel is in a form which, when combined with a supercritical fluid, is able to be sprayed and form the desired droplet sizes.

In some embodiments, in the contacting step 30, an excess of liquid hydrocarbon is used relative to the stoichiometric amount of gaseous hydrocarbon. In one embodiment, the molar ratio between gaseous hydrocarbons and liquid hydrocarbons is in a range of from about 1:20 to about 1:2, or from about 1:18 to about 1:4, or from about 1:16 to about 1:5, or from about 1:14 to about 1:6, or from about 1:12 to about 1:7, or from about 1:10 to about 1:8.

In some embodiments, a catalyst may optionally be present to catalyze the incorporation of the activated gaseous hydrocarbons into the liquid hydrocarbons. In one embodiment, the incorporation occurs in a reaction chamber where the catalyst may be located. Such catalysts can increase incorporation yields and reduce reaction time. Exemplary catalysts include, without limitation, metals, nanospheres, wires, supported catalysts, and soluble catalysts. As used herein, "nanosphere" or "nanocatalyst" refers to a catalyst in which the average diameter of the catalyst is in a range of 1 nm to 1 μm. In some embodiments, the catalyst is an oil soluble catalyst. Such catalysts disperse well and do not precipitate during oil processing. In some embodiments, the catalyst may be a bifunctional catalyst, for example one that includes an inorganic base and a catalyst containing a transition metal such as iron, chromium, molybdenum, or cobalt.

In some embodiments, a catalyst is present in the reaction process at levels of about 0.03% to about 15% by weight of the total reaction mass. In some embodiments, the catalyst is present at a level of about 0.5-2.0%% by weight of the total reaction mass. In one non-limiting exemplary embodiment, the concentration of catalyst introduced into the reactant mixture is from about 50 ppm, to about 100 ppm, based on the total reaction mixture. In some embodiments, the catalyst is present at a level of at least about 50 ppm. In some embodiments, the catalyst is present at a level ranging from about 50 ppm to about 80 ppm of the reaction mixture.

In some embodiments, the catalyst is an organometallic compound. Exemplary organometallic compounds contain a transition metal, a transition metal-containing compound, or mixtures thereof. Exemplary transition metals in the catalysts include elements selected from the Group V, VI and VIII of the Periodic Table. In certain embodiments, the transition metal of the catalysts is one or more of vanadium, molybdenum, iron, cobalt, nickel, aluminum, chromium, tungsten, manganese. In some embodiments, the catalyst is a metal naphthanate, an ethyl sulfate, or an ammonium salt of polymetal anions. In one embodiment, the catalyst is an organomolybdenum complex (e.g., MOLYVAWM 855 (R.T. Vanderbilt Company, Inc. of Norwalk, Conn., CAS Reg. No. 64742-52-5), an organomolybdenum complex of organic amide containing about 7% to about 15% molybdenum. In another embodiment, the catalysts is HEX-CEM (Mooney Chemicals, Inc., Cleveland, Ohio, containing about 15% molybdenum 2-ethylhexanote) or bimetallic wire, shavings or powder catalyst that is H25/L605 (Altemp Alloys, Orange Calif.) that includes about 50-51% cobalt, 20% chromium, about 15% tungsten, about 10% nickel, up to about 3% iron, and 1.5% manganese.

In further embodiments, other suitable catalysts include compounds that are highly soluble in the liquid fuel while having a relatively high loading of molybdenum. In some embodiments, the catalyst imparts lubricity to the fuel, which is necessary for ultra-low-sulfur diesel products. In some embodiments, the organometallic compound adds lubricity to the liquid fuel, as well as serving as a catalyst, thereby avoiding the need to add further lubricity additives to the final hybrid fuel product. Other organometallic compounds that are useful for the processes disclosed herein are those disclosed in U.S. Pat. Nos. 7,790,018 and 4,248,720, both of which are hereby incorporated herein by reference.

In some embodiments, the catalyst can be supported on a zeolite. The catalysts can be in the form of pellets, granules, wires, mesh screens, perforated plates, rods, and or strips. In one illustrative implementation, a catalyst mixture includes aluminum wire, cobalt wire (an alloy containing approximately 50% cobalt, 10% nickel, 20% chromium, 15% tungsten, 1.5% manganese, and 2.5% iron), nickel wire, tungsten wire, and cast iron granules. In another embodiment, the catalyst is in the form of a metal alloy wire. Such metal alloy wires include, without limitation, the transition metals described above including without limitation, organomolybdenum catalysts. The catalysts can be arranged in a fixed or fluid-bed arrangement in combination with gas and liquid fuel.

The mixture of gaseous hydrocarbons and liquid fuel, after the contacting step 30, is passed into a collection vessel, which may be a condenser. The gaseous phase in the headspace of the collection vessel, which is mostly composed of unincorporated gaseous hydrocarbons, may be recycled back to the exposing step 20 via a pump/compressor. Meanwhile, the liquid phase in the collection vessel comprises the liquid fuel with incorporated gaseous hydrocarbons.

The liquid phase can be removed from the collection vessel and further separated via a separator into heavy fractions, alkanes and sulfur compounds. The separator can include a filter, membrane, centrifuge, still, column, and/or other known apparatus for separating liquids and solids as well as separating different liquid fractions from one another.

The present invention has a high conversion rate (i.e. yield) of incorporation of gaseous hydrocarbons into the liquid fuel. In some embodiments, the conversion rate of the gaseous hydrocarbons is from about 5% to about 50%, or from about 7% to about 40%, or from about 10% to about 30%, or from about 15% to about 25%, or from about 17% to about 22%, or from about 18% to about 20%. In some embodiments when the unreacted gaseous hydrocarbon is recycled back to contact with the nonthermal plasma, the overall conversion rate of the gaseous hydrocarbon may be greater than about 80%, or greater than about 85%, or greater than about 88%, or greater than about 90% or greater than about 92%, or greater than about 95%, or greater than about 98%. In some embodiments, the overall conversion rate of the gaseous hydrocarbons is from about 80% to about 99.5%, from about 80% to about 98%, from about 80% to about 95%, from about 85% to about 99.5%, from about 85% to about 98%, or from about 85% to about 95%. In some embodiments, the conversion rate of the gaseous hydrocarbons is from about 80% to about 90%.

In one exemplary embodiment, 1,000 barrels of heavy crude oil is processed with the present invention by exposing the crude oil to the non-thermal plasma activated methane molecules. The activated methane reacts with and permanently incorporates into the crude oil, to produce about 1,300 barrels of oil at a level of about 30% methane incorporation by weight. In addition to increasing the total amount of the oil from 1,000 barrels to 1,300 barrels, the process also increases the hydrogen content of the oil and decreases its viscosity. This exemplary embodiment can be repeated using "drop-in" fuels for expanding the volume and improving the performance qualities of the "drop-in" fuels.

The present invention may be implemented using a plasma liquefaction system (PLS) with non-thermal plasma generated by a high gas flow gliding arc discharge, a microwave discharge, a corona or atmospheric pressure glow discharge, or a dielectric barrier discharge.

Atmospheric pressure glow discharge is a preferred method for generating the non-thermal plasma. To employ an atmospheric pressure glow discharge, the gaseous hydrocarbon is placed in an electric field under atmospheric pressure. A glow discharge under atmospheric pressure generates non-thermal plasma. The combination of the gaseous hydrocarbon, non-thermal plasma and a liquid hydrocarbon leads to incorporation of the gaseous hydrocarbon into the liquid hydrocarbon. In one embodiment, the gaseous hydrocarbon is presented as bubbles in the liquid hydrocarbon in the electric field and plasma is generated in the bubbles to activate the gaseous hydrocarbon thereby providing activated gaseous hydrocarbon, such as the $CH_4$* as discussed herein. The activated gaseous hydrocarbon, being within the liquid hydrocarbon, will necessarily contact the liquid hydrocarbon and be incorporated therein. In one embodiment, the gaseous hydrocarbon is introduced to the liquid from below or at a lower portion of the liquid in order to allow the gaseous hydrocarbon to rise through the liquid thereby increasing the contact time between the gaseous hydrocarbon and the liquid hydrocarbon.

The provision of the gaseous hydrocarbon as bubbles in the liquid hydrocarbon with an atmospheric pressure glow discharge leads to efficient incorporation of the gaseous hydrocarbon into the liquid hydrocarbon. This is because the generated plasma is unstable at atmospheric pressure and thus the activated gaseous hydrocarbon molecules exist for only a very short period of time. This creates more opportunities for the activated gaseous hydrocarbon to contact the liquid hydrocarbon thereby leading to a significant increase in the efficiency of gaseous hydrocarbon liquefaction.

One potential drawback for plasma generated by atmospheric pressure glow discharge is the relatively high density of molecular particles in the gaseous hydrocarbon at atmospheric pressure (instead of vacuum). As a result, the activated species of the gaseous hydrocarbon will typically have a relatively short free path before colliding with another activated gaseous hydrocarbon molecule and potentially losing energy. Thus, in some embodiments, the bubbles containing gaseous hydrocarbon introduced into the liquid hydrocarbon may further comprise an inert gas, such as $N_2$. In some embodiments, the volume ratio between gaseous hydrocarbon and the inert gas is in a range of from about 1:1 to about 20:1, or from about 2:1 to about 15:1, or from about 5:1 to about 12:1, or from about 7:1 to about 12:1, or from about 9:1 to about 11:1.

In some embodiments, the gaseous hydrocarbon may be dried before exposure to the non-thermal plasma in order to prevent quenching of the activated gaseous hydrocarbon with water. The gaseous hydrocarbon may be dried by passing it through a silica gel tube, a molecular sieve or any other suitable drying means.

To generate the atmospheric pressure glow discharge, at least one pair of electrodes, a high voltage (HV) electrode and a ground electrode, are used to produce an electrical field with an E/N ratio in a range of from about 10 to about 30 Td. In preferred embodiments, the gaseous hydrocarbon is introduced to the space between the two electrodes. The electrical field generates plasma between the electrodes, and the plasma excites the gaseous hydrocarbon to produce activated gaseous hydrocarbon.

The electrodes for generating atmospheric pressure glow discharge are driven by a voltage in which may be in a range of from about 1 kV to about 5 kV, or from about 1.2 kV to about 4.5 kV, or from about 1.5 kV to about 4 kV, or from about 1.7 kV to about 3.5 kV, or from about 2 kV to about 3 kV. The current may be in a range of from about 0.2 mA to about 10 mA, or from about 0.4 mA to about 8 mA, or from about 0.6 mA to about 6 mA, or from about 0.8 mA to about 4 mA, or from about 1.0 mA to about 2.0 mA.

In some embodiments, the voltage may be even higher, for example, in a range of from 5 kV to about 50 kV, or from about 10 kV to about 40 kV, or from about 20 kV to about 30 kV. In some embodiments, the voltage may be associated with a direct current for applying high voltage to the electrodes. In some other embodiments, the voltage may be associated with an alternating current for driving the electrodes. Such an alternating current may have a frequency in a range of from about 1 kHz to about 500 kHz, or from about 5 kHz to about 400 kHz, or from about 10 kHz to about 300 kHz, or from about 15 kHz to about 200 kHz, or from about 20 kHz to about 150 kHz, or from about 20 kHz to about 100 kHz, or from about 25 kHz to about 75 kHz.

Parameters of the electrical potential applied to the electrodes are selected to prevent dissociation and pyrolysis of gaseous and liquid hydrocarbons, as well as to achieve only vibrational/translational excitation of methane molecules followed by incorporation into the liquid fuel. Depending on the particular gaseous hydrocarbon used in the process, a person skilled in the art can adjust the voltage, current, and/or frequency to achieve these goals.

In some embodiments, the gaseous hydrocarbon is continuously introduced into the liquid hydrocarbon and exposed to the non-thermal plasma generated between the electrodes to provide a continuous process. In this process, liquid hydrocarbon may also be fed continuously to the plasma generation zone, if desired. The duration of the process may be determined by the degree of unsaturation of the liquid hydrocarbon. As understood by a person skilled in the art, a liquid hydrocarbon with a higher degree of unsaturation will typically require a longer treatment time to saturate the liquid hydrocarbon. The liquid fuel may be periodically tested during the treatment process in order to monitor the progress of the reaction in terms of the degree of saturation of the liquid hydrocarbon. In some embodiments, the liquid hydrocarbon may be treated in the presence of gaseous hydrocarbon and plasma for up to about 5 minutes, or up to about 10 minutes, or up to about 15 minutes, or up to about 20 minutes, or up to about 30 minutes, or up to about 45 minutes, or up to about 1 hour, or up to about 1.5 hours, or up to about 2 hours, or up to about 3 hours, or up to about 4 hours.

Without wishing to be bound by theory, the incorporation of an exemplary gaseous hydrocarbon such as methane from natural gas, into a liquid hydrocarbons ($R_1{=}R_2$) involves saturation of the hydrocarbon molecules, as shown below:

$$R_1{=}R_2+CH4 \rightarrow HR_1{-}R_2CH_3, \Delta H=-0.5\ eV/mol$$

This reaction is exothermic and thus the energy cost is not more than 0.3 eV/mol of $CH_4$. On the other hand, other reactions involving liquid hydrocarbons that may be induced by the non-thermal plasma, such as polymerization and dissociation, are strongly endothermic and therefore are not favored during the direct liquefaction process.

The use of atmospheric pressure glow discharge to generate non-thermal plasma has a few advantages:

- ease of scale-up to industrial scale, since multiple pairs of electrodes could be connected to a single power supply for plasma generation; and
- generation of the non-thermal plasma within the liquid hydrocarbon, where the direct interaction of plasma, gaseous hydrocarbon and liquid hydrocarbon ensures a high incorporation efficiency.

The following described exemplary embodiments use methane as the gaseous hydrocarbon. However, it should be understood that other gaseous hydrocarbons, such as ethane and propane, may also be used in these exemplary embodiments.

All these discharges should operate at a pressure range 0.1-3 atm; gas temperature—22-300 C. Ratio of plasma power to gas flow rate (average enthalpy) should be not more than 0.3 kW-h/m3 of CH4. Maintaining this ratio should ensure E/N 10-30 Td.

An embodiment of present invention is shown in FIG. 1, where a plasma liquefaction system 100 (PLS) including a plasmatron 105 is shown. The PLS 100 shown in FIG. 1 comprises a plasma reactor 103, a gas pump 110, flow lines and a condenser 114.

The plasma reactor 103 is adapted to hold liquid fuel 104 and further comprises the plasmatron 105. The plasmatron 105 generates a gliding arc plasma discharge 106 using a high voltage (HV) electrode 115, a ground electrode 116 and energy supplied from a power source (not shown). It should be understood that the power source that is used may be any power source that capable of providing sufficient energy to generate a gliding arc plasma discharge 106.

When the PLS 100 is used, natural gas passing through the gliding arc plasma discharge 106 is activated into a reactive state and is incorporated into liquid fuel 104 thus increasing the volume of liquid fuel 104 that is held within the plasma reactor 103.

The remaining volatile light hydrocarbons and liquid fuel micro droplets located within the reactor 103 may be removed from the plasma reactor 103 via an exhaust port 109. The volatile light hydrocarbons and the liquid fuel micro droplets are then transferred into a condenser 112. The condenser 112 may be cooled by air, water or some other means adequate to provide cooling, such as a refrigerant. A gas pump 110 may then pump the unreacted natural gas through the flow lines 111 and into the entry port 113. The unreacted natural gas may be recirculated back to the plasmatron 105.

The PLS 100 may be maintained at a pressure between 0.1-3 atm which may be maintained and monitored via a pressure gauge 108 operably connected to the plasma reactor 103. During the plasma liquefaction process the $CH_4$ pressure in the PLS 100 decreases and fresh natural gas is continuously added to the PLS 100. Additional produced liquid fuel 104 is periodically removed from the plasma reactor 103 and condenser 112.

In this embodiment, natural gas passing through non-thermal plasma generated by the gliding arc plasma discharge 106 is activated into a reactive state and incorporates into the liquid fuel thus increasing its volume. Unreacted natural gas and liquid fuel micro droplets entrained in the exhaust gas flow condense in the water cooled condenser 112. A gas pump is used to recirculate unreacted natural gas back into the gliding arc plasmatron 105. The temperature at which this occurs is preferably room temperature to about 300° C. Temperature may be maintained by conventional heaters.

Figure 2:
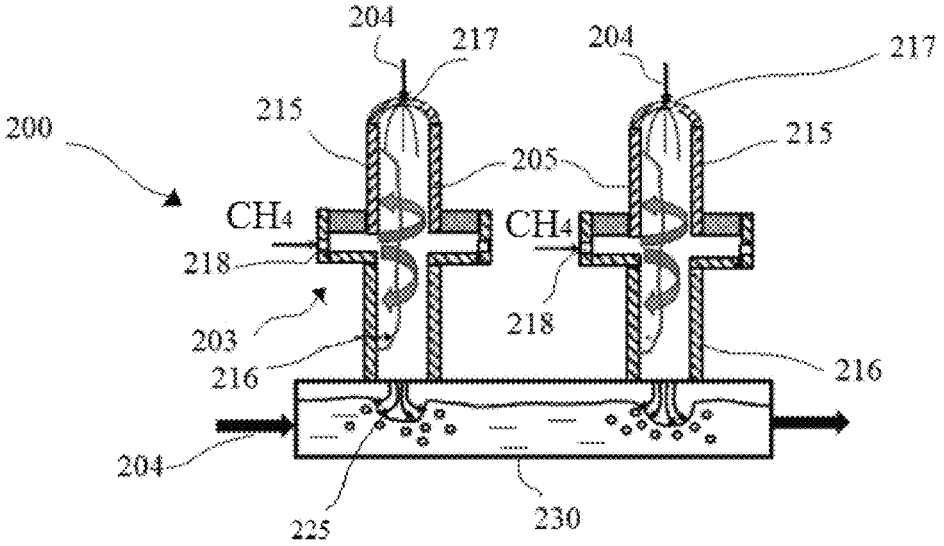
FIG. 2 shows an embodiment of the present invention that employs an array of gliding arc discharges to generate non-thermal plasma.

Another embodiment of the present invention is shown in FIG. 2. Elements in FIG. 2 having similar numbers to the elements of FIG. 1 share the same capabilities. In FIG. 2, a PLS 200 is shown that provides for the continuous liquefaction of the flowing stream of liquid fuel 204.

In the PLS 200 shown in FIG. 2 an array of plasmatrons 205 is used in the plasma reactor 203. By "array" it is meant that more than one plasmatron 205 is employed. Each plasmatron 205 is comprised of a HV electrode 215 and a ground electrode 216 each of which is operably connected to a power source. The HV electrode 215 and ground electrode 216 generate a gliding arc plasma discharge 206.

Also part of the PLS 200 is a liquid fuel tube 230. The array of plasmatrons 205 of plasma reactor 203 is fluidly connected to the liquid fuel tube 230. The liquid fuel tube 230 may be sized to carry as much liquid fuel 204 as desired.

In PLS 200 each plasmatron 205 operates on natural gas while part of liquid fuel 204 is injected into the plasma reactor 203 through liquid fuel entry ports 217. The liquid fuel entry ports 217 are located within the HV electrodes 215. Liquid fuel 204 passes through the gliding arc plasma discharge 206. Methane is also injected into the plasmatron 205 via gas entry port 218. The liquid fuel 204 is then activated in the gliding arc plasma discharge 206 and the methane reacts with micro droplets and vapor of liquid fuel 204 thus providing efficient methane incorporation.

This gas/liquid mixture 225 is then injected into a continuously flowing stream of liquid fuel 204 that moves through the liquid fuel tube 230 where the plasma chemical reaction goes to completion.

The process used in the PLS 200 could be scaled up to any required level by adding additional gliding arc plasmatrons 205. Unreacted natural gas can be recirculated back into the plasmatrons 205 in the same way as discussed above in order to recycle this reaction to PLS 100.

Figure 3:
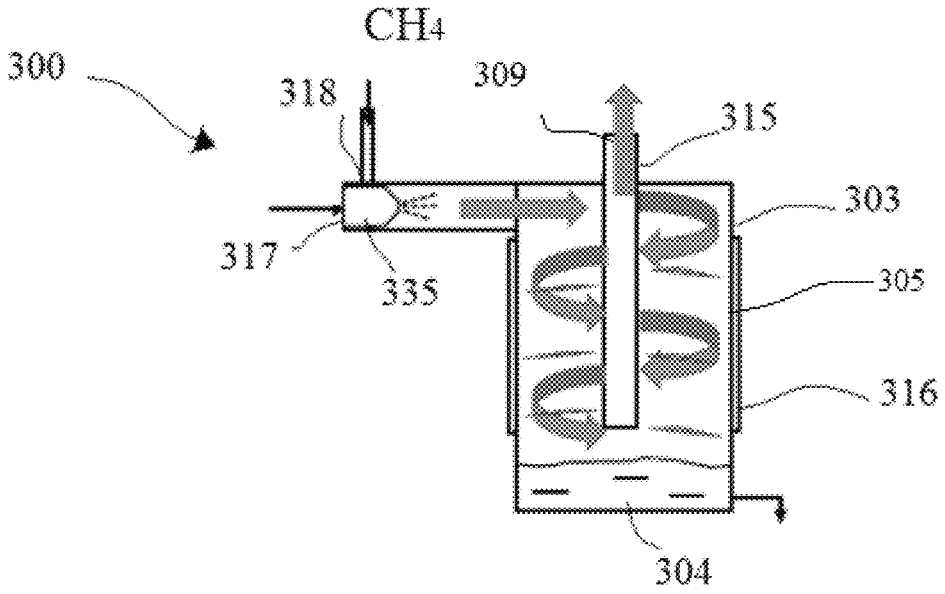
FIG. 3 shows an embodiment of the present invention that employs a dielectric barrier discharge to generate non-thermal plasma.

Another embodiment of the present invention that uses DBD discharge is shown in FIG. 3. Elements in the FIG. 3 embodiment having similar numbers to the elements in FIGS. 1 and 2 share the same capabilities. In FIG. 3, a PLS 300 is shown that provides for the continuous liquefaction of a flowing stream of liquid fuel 204.

The PLS 300 comprises a plasma reactor 303, which in the embodiment shown may be a DBD reactor that comprises a HV electrode 315 and a ground electrode 316. A plasma discharge 306, which in the embodiment shown is a DBD plasma discharge, is generated between the HV electrode 315 and the ground electrode 316.

The PLS 300 uses a pneumatic nozzle 335 located at the liquid fuel entry port 317 and the gas entry port 318. The liquid fuel 304 is atomized in the pneumatic nozzle 335 to micro-droplet size. In particular, the range of the diameters of the micro-droplets may be from 10-30 microns. The micro-droplets are mixed with methane and injected tangentially into the plasma reactor 303. After exposure to the plasma discharge 306 of the plasmatron 305, droplets of processed liquid fuel 304 are collected on the walls and then at the bottom of plasma reactor 303. Unreacted gas may exit from the plasma reactor 303 via a channel in the HV electrode 315. It should be understood that in the same way PLS 100 recycled unreacted methane or natural gas, the methane or natural gas in the PLS 300 may also be recirculated back to the plasma reactor 303.

Figure 4:
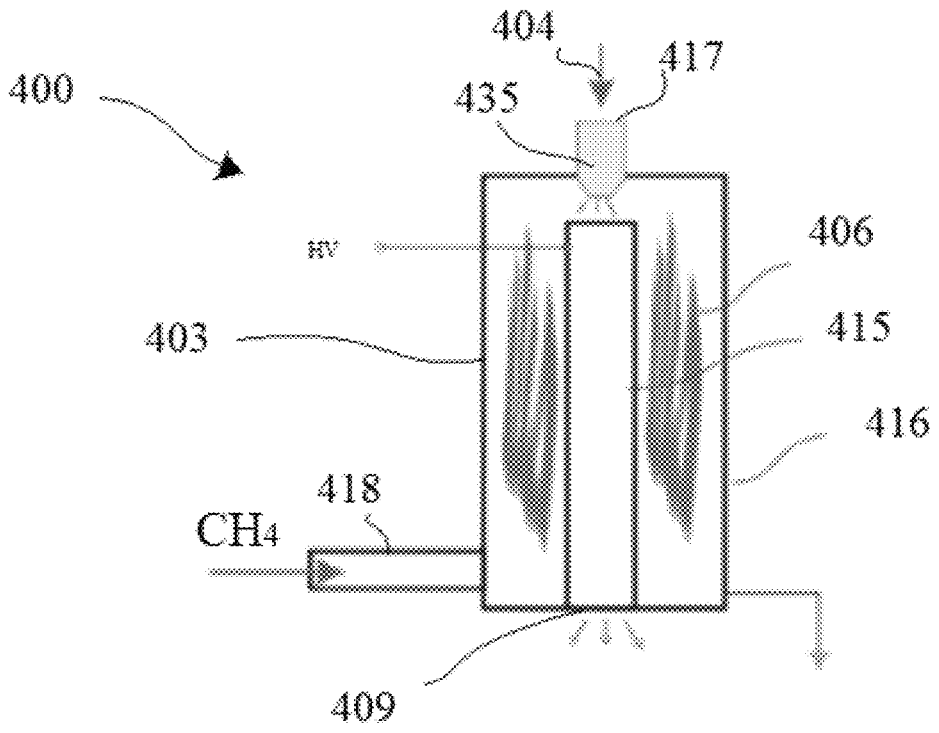
FIG. 4 depicts an alternative embodiment of the present invention that employs a dielectric barrier discharge to generate non-thermal plasma.

Another embodiment of the present invention is shown in FIG. 4. Elements in the FIG. 4 embodiment that have similar numbers to the elements in FIGS. 1-3 share the same capabilities. In FIG. 4, a PLS 400 is shown that employs a coaxial arrangement of HV electrode 415 and ground electrode 416, In PLS 400, a dielectric barrier discharge is ignited within a coaxial configuration of HV electrode 415 and ground electrode 416. In PLS 400 the liquid fuel 404 is injected via liquid fuel entry port 417 after the plasma discharge 406 using pneumatic nozzle 435. Pneumatic nozzle 435 atomizes the liquid fuel 404. Low electric field dielectric barrier discharge can be generated in the case of strong overvoltage provided by short pulses and fast rise times. To be specific, for atmospheric pressure, the applied voltage pulse is preferably shorter than about 1000 ns, more preferably shorter than about 100 ns and most preferably shorter than about 10 ns with rise time less of less than preferably 100 ns, more preferably less than 10 ns and most preferably less than 1 ns. The shorter the applied voltage pulse and the faster the rise time, the better. The amplitude of applied voltage pulse should be greater than 30 kV when there is a 1 cm gap between electrodes, and greater than 10 kV when there is about a 2-3 mm gap between electrodes. The amplitude of the applied voltage pulse is preferably adjusted based on the gap provided between electrodes.

Gas entry port 418 is located at the bottom of the plasma reactor 403. Here, plasma activated methane is mixed with the liquid fuel 404 immediately after the plasma discharge 406, thereby causing methane incorporation into the liquid fuel 404. This allows effective methane activation with stable and controllable ignition of the plasma discharge 406.

Figure 5:
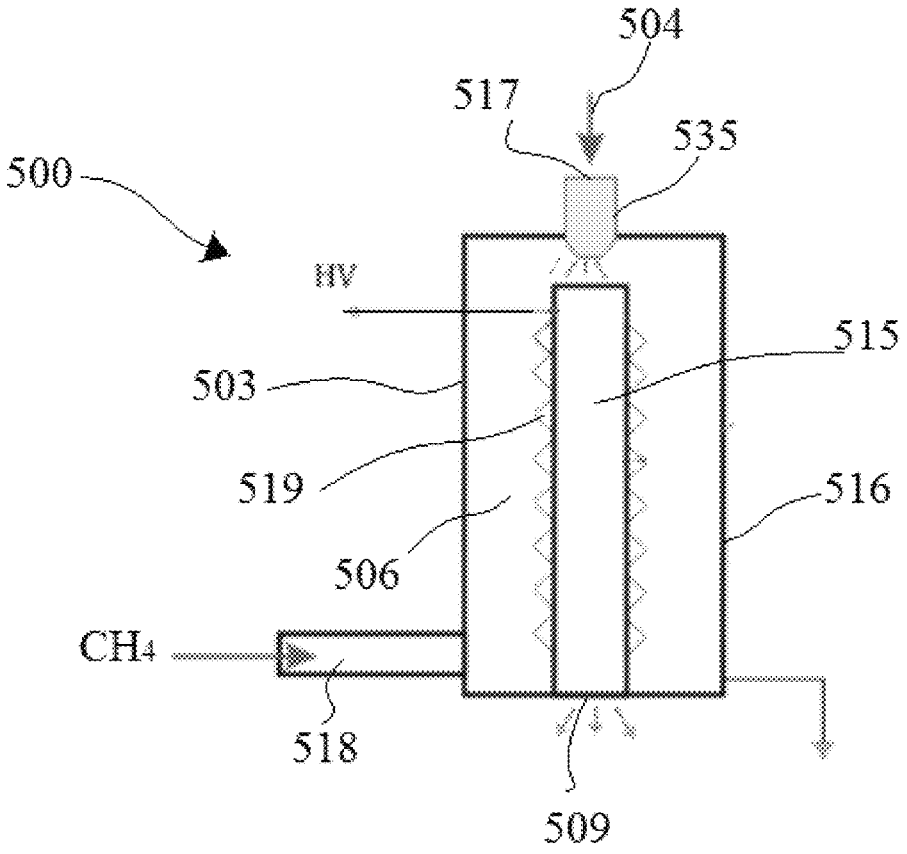
FIG. 5 shows an embodiment of the present invention that employs a corona discharge to generate non-thermal plasma.

Another embodiment of the present invention is shown in FIG. 5. Elements in the FIG. 5 embodiment having similar numbers to the elements in FIGS. 1-4 share the same capabilities. In FIG. 5, PLS 500 also employs a coaxial arrangement of HV electrode 515 and ground electrode 516.

Similar to PLS 400, in PLS 500 the liquid fuel 504 is injected downstream of the location of activation of the methane by the plasma discharge 506 via liquid fuel entry port 517 using pneumatic nozzle 535. Pneumatic nozzle 535 atomizes the liquid fuel 504. Gas entry port 518 is located at the bottom of the plasma reactor 503. However, in PLS 500 a corona discharge 506 is used for methane activation and incorporation into the liquid fuel 504. In this case HV electrode 515 is composed of multiple needle-like electrodes 519 that facilitate ignition of a corona discharge 506. The corona discharge 506 can be ignited in either a stable direct current mode or a pulsed mode.

Figure 8:
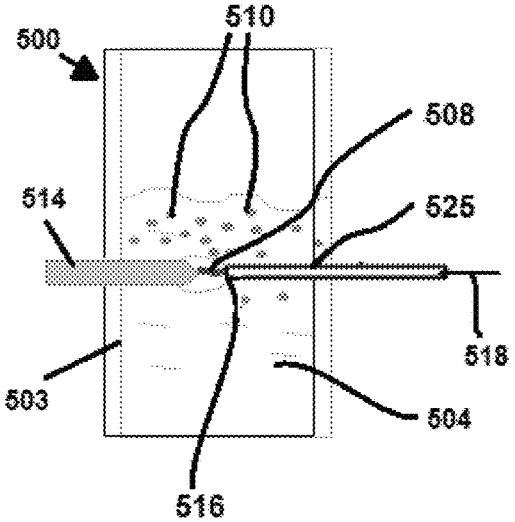
FIG. 8 shows an embodiment of the present invention that employs an atmospheric pressure glow discharge to generate non-thermal plasma using a single tubular HV electrode.

In one embodiment, the PLS 500 may employ atmospheric pressure glow discharge 508 for liquefaction of a gaseous hydrocarbon 510 such as natural gas as shown in FIG. 8. In this embodiment, the ground electrode 514 and the HV electrode 525 are submerged in the liquid hydrocarbon 504. The atmospheric pressure glow discharge 506 is generated between the ground electrode 514 and the tip 516 of the HV electrode 525 which is located proximate to the ground electrode 514. The ground electrode 514 may be in the form of, for example, a rod as shown in FIG. 8, and the HV electrode 525 may be a tubular electrode as shown in FIG. 8. The tubular HV electrode 525 can be used as an entry port for the introduction of the gaseous hydrocarbon 510 into the liquid fuel 504. Specifically, the gas entry port 518 is connected to the lumen of tubular HV electrode 525 to deliver the gaseous hydrocarbon 510 to the liquid fuel 504 at the location where the atmospheric pressure glow discharge 508 is generated in order to improve the conversion efficiency.

Figure 9:
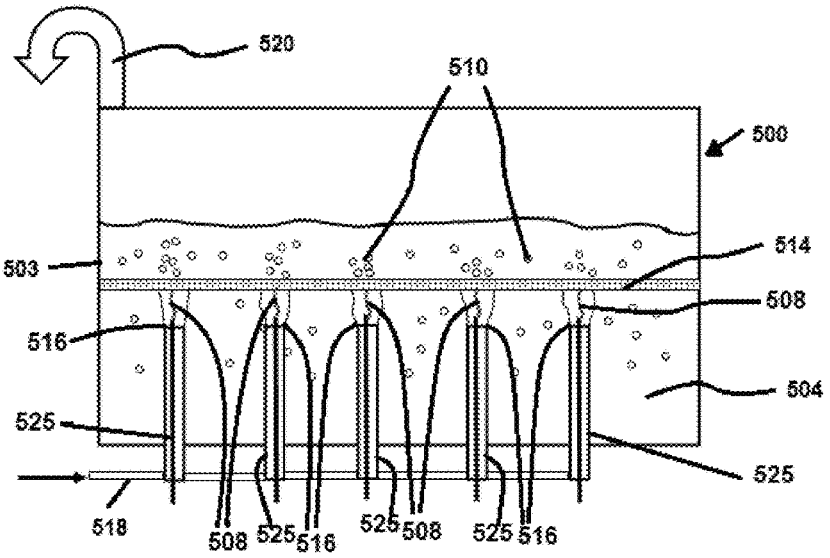
FIG. 9 shows an embodiment of the present invention that employs an atmospheric pressure glow discharge to generate non-thermal plasma using a plurality of vertically oriented tubular HV electrodes.

In yet another embodiment, a PLS 500 employing atmospheric pressure glow discharge 508 may be implemented as shown in FIG. 9. In this embodiment, a plurality of HV electrodes 525 are used to generate the atmospheric pressure glow discharge 508 at a plurality of locations in the liquid fuel 504. Each of the HV electrodes 525 may also be implemented as tubular electrodes that are connected with the gas entry port 518 for feeding the gaseous hydrocarbon 510 to the liquid fuel 504 at the location of plasma discharge generation via the HV electrodes 525. The ground electrode 514 may be implemented as a metal mesh. The plurality of HV electrodes 525 may be oriented vertically and may be parallel to each other. The tips of each of the plurality of HV electrodes 525 are located proximate to the ground electrode 514 to generate the atmospheric pressure glow discharge 506.

As shown, the embodiment of FIG. 9 additionally includes a gaseous hydrocarbon recycle 520 to collect and recycle unreacted gaseous hydrocarbon 510 exiting the liquid fuel 504. The unreacted gaseous hydrocarbon 510 may be recycled back to the liquid fuel 504 through via the gas entry port 518 and tubular HV electrodes 525.

Figure 10:
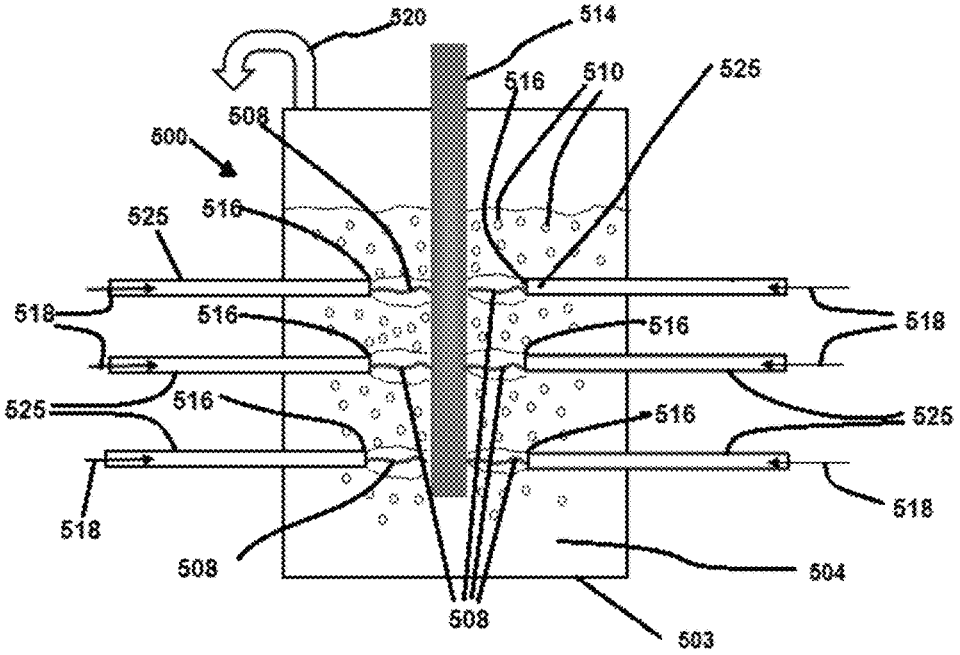
FIG. 10 shows an embodiment of the present invention that employs an atmospheric pressure glow discharge to generate non-thermal plasma using a plurality of horizontally oriented tubular HV electrodes.

In yet another embodiment, shown in FIG. 10, the PLS 500 may employ a plurality of HV electrodes 525 oriented in a substantially horizontal direction to generate a plurality of atmospheric pressure glow discharges 508, which HV electrodes 525 may also be parallel to each other. The ground electrode 514 is again located proximate to the tips of the HV electrodes 525. In this embodiment, the HV electrodes 525 are also tubular electrodes and are connected to the gas entry port 518 for the gaseous hydrocarbon 510. The atmospheric pressure glow discharge 508 is generated at each tip 516 of the HV electrode 525. This embodiment also includes an unreacted gaseous hydrocarbon recycle 520 to collect unreacted gaseous hydrocarbon 510 exiting the liquid fuel 504 and recycle the collected unreacted gaseous hydrocarbon 510 back to the liquid fuel 504 via gas entry port 518 and HV electrodes 525.

One advantage of the present invention is that it requires significantly less energy in comparison with prior art processes, because the present invention does not break chemical bonds in the gaseous hydrocarbons, which requires significantly more energy. The theoretical energy cost of methane incorporation in the present invention should not exceed 0.3 eV/mol (7 kcal/mole), which corresponds to an OPEX cost of 0.3 kW-h per 1 $m^3$ of incorporated natural gas, or a cost of about US$30 per barrel of generated additional liquid fuel. This is about four times lower than the energy cost of a conventional Gas-to-Liquid process using Fisher-Tropsch synthesis. In practice, the energy cost of methane incorporation using the present invention is 0.3-0.5 eV/mol, corresponding to about US$30-50/barrel of generated liquid fuel. In comparison, it is estimated that the energy cost of carrying out the process of US 2011/0190565, which uses electric fields having an E/N RATIO of about 300-1000 Td, is on the order of 10-20 eV/mol. Further, it is estimated that the energy cost of executing the process of US 2012/0297665, which also uses very high reduced electric fields, is on the level 20-30 eV/mol.

The present invention uses vibrational excitation of gaseous hydrocarbons (e.g., methane) by the non-thermal plasma, followed by surface chemisorption and incorporation into liquid hydrocarbons in the liquid fuel. This process stimulates exothermal and thermo-neutral processes of gaseous hydrocarbon incorporation into liquid hydrocarbons. As proved in plasma kinetic calculations, this process permits the incorporation of methane with an energy cost of about 0.3 eV/mol. Finally it should be mentioned that numerous researchers have tried to convert $CH_4$ into liquid hydrocarbons using plasma dissociation processes through intermediates such as $H_2$, CH radicals and other active species. This process proved to be very energy consuming and not economically feasible for industrial application.

The capital cost of operating the present invention on a commercial scale will be about OPEX of $30/barrel generated liquid fuel (~$1/gallon) and CAPEX—$2,100 per barrel/day. Total OPEX and CAPEX assuming 20 years plant life (and ~1,000 days maintenance) is $30/barrel (~$1/gallon). For comparison, the process based on Fischer-Tropsch synthesis has an OPEX—$15/barrel ($0.5/gallon) and CAPEX—$100,000 per barrel/day. Total OPEX and CAPEX assuming 20 years plant life (and ~1,000 days maintenance) is $120/barrel (~$4/gallon). Therefore, the present invention is about four times cheaper when compared with the Fischer-Tropsch synthesis based process.

The devices described herein are amenable to being modular, scalable, and portable, thus enabling transport to, and use at, otherwise hard to reach areas, such as off-shore drilling rigs and environmentally sensitive areas. The devices are capable of converting natural gas into a stable fuel such as diesel, gasoline, light synthetic oil, kerosene and other hydrocarbon fuels that can be transported over the road, sea or rail in ordinary fuel transport vehicles.

EXAMPLES

The following examples are illustrative, but not limiting, of the methods and compositions of the present disclosure. Other suitable modifications and adaptations of the variety of conditions and parameters normally encountered in the field, and which are obvious to those skilled in the art, are within the scope of the disclosure.

Example 1

Figure 6A:
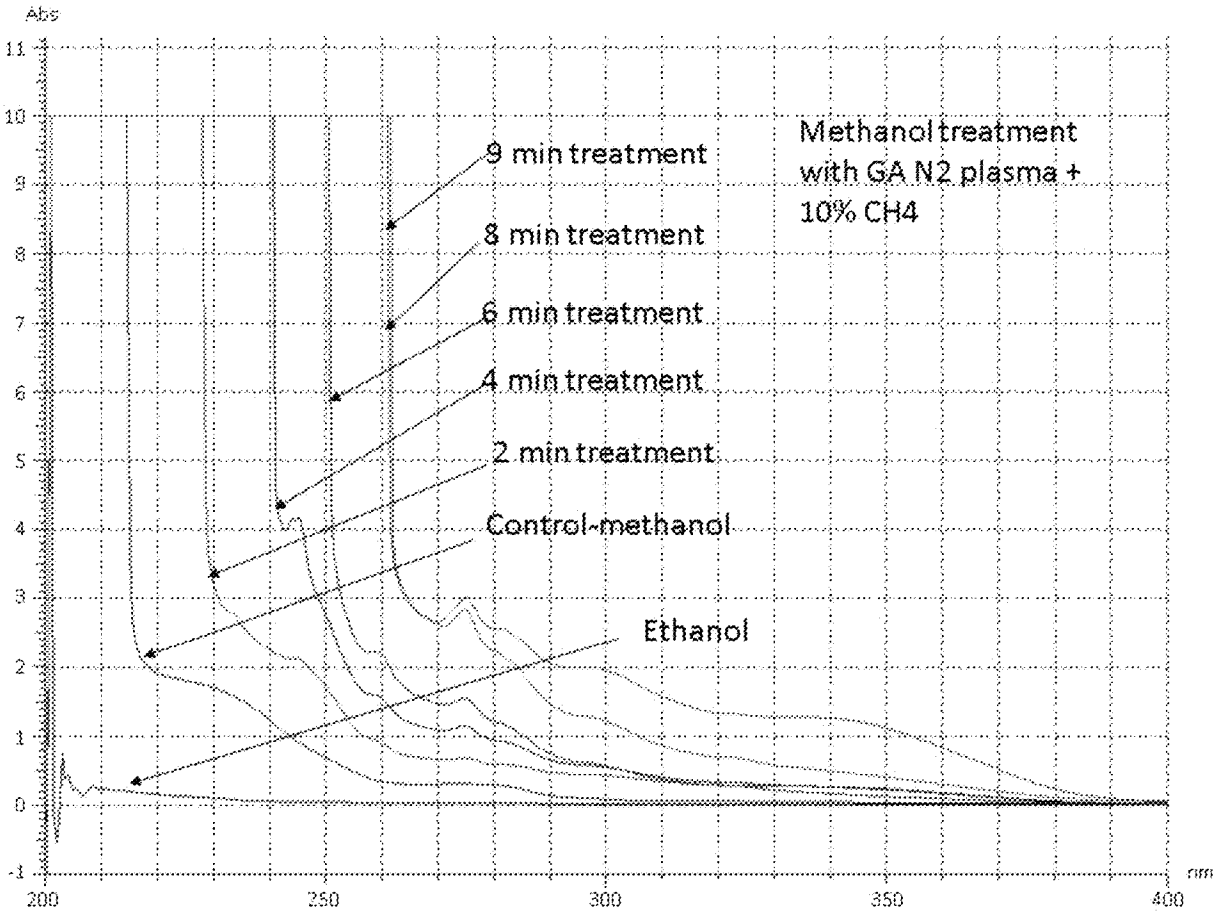
FIGS. 6A and 6B show the changes in a methanol composition during gliding arc non-thermal plasma treatment of a $N_2$+$CH_4$ mixture, as conducted in Example 1.
Figure 6B:
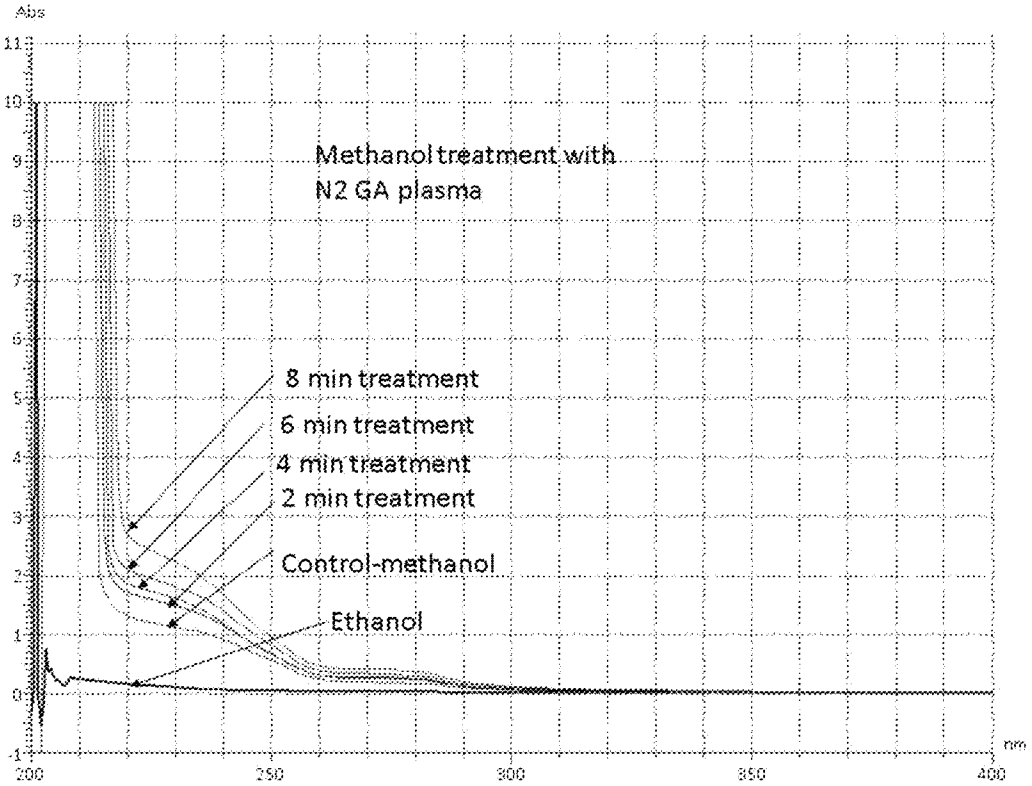

In a feasibility study, 0.5 L of methanol was treated for 9 minutes by a gliding arc plasmatron. The nozzle of the plasmatron was submerged in the methanol. Plasma power was ~200 W. The plasma gas was $N_2$ with 10% of $CH_4$. Gas chromatographic analysis showed that during the treatment ~25% of $CH_4$ disappeared. At the same time an analysis of the liquid methanol performed by spectrophotometry showed an increased quantity of unidentified (presumably liquid hydrocarbons) compounds in the liquid (see FIGS. 6A and 6B). FIG. 6A shows changes in the liquid composition during gliding arc treatment with an $N_2$+$CH_4$ mixture, while FIG. 6B is a control treatment with only $N_2$-containing plasma.

Example 2

In this example, plasma was used to stimulate direct liquefaction of methane into a liquid mixture of 30% methylnaphthalene (aromatic compound) and 70% hexadecane (aliphatic compound). The two compounds served as surrogates for hydrocarbon compounds commonly found in diesel fuels. The objectives of this example were to determine (i) the selectivity of plasma stimulated methane incorporation into aromatics and aliphatics, (ii) the extent of aromatic ring saturation.

Figure 11A:
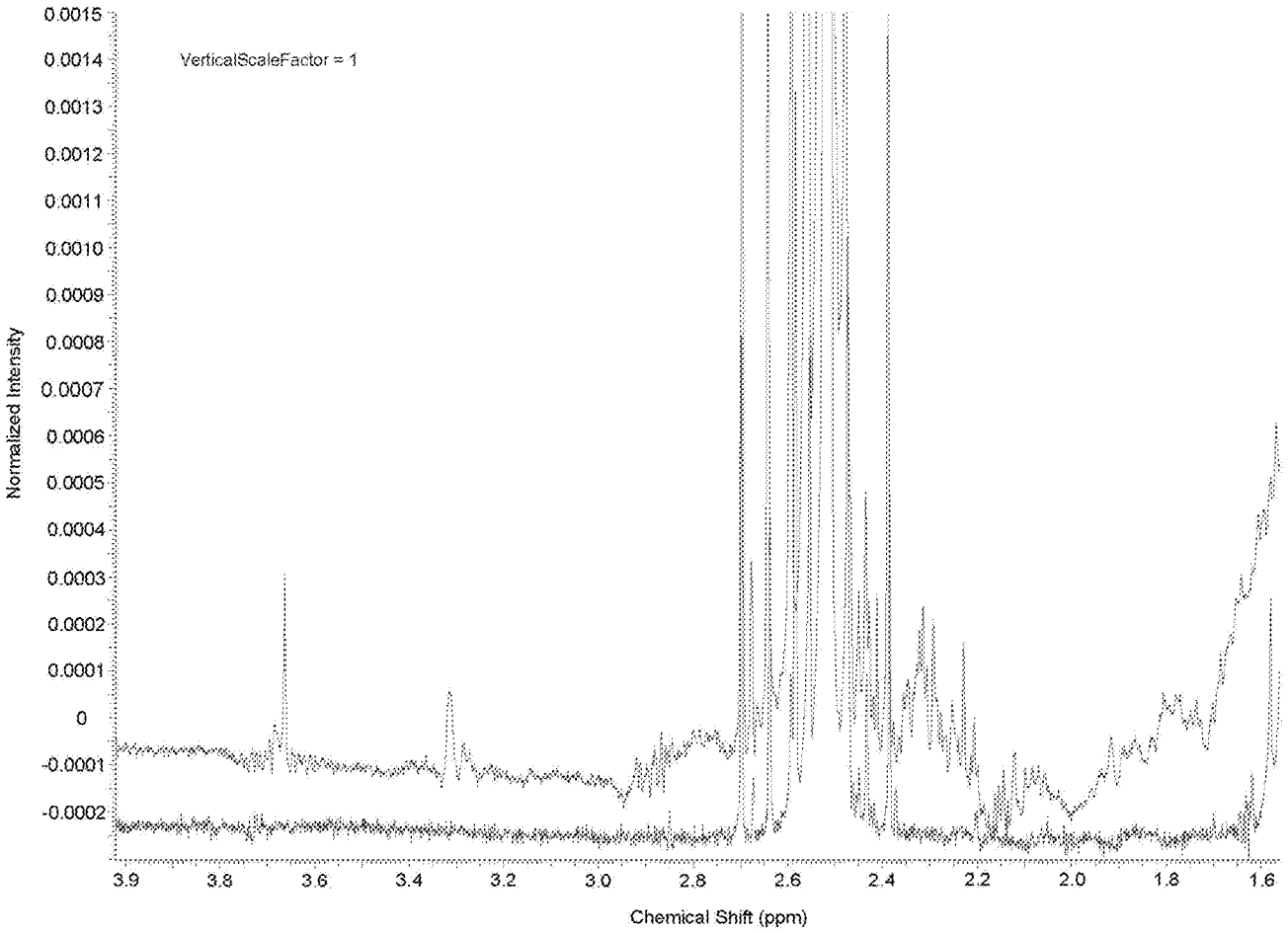
FIG. 11A is an NMR spectra of the liquid mixture of 30% methylnaphthalene and 70% hexadecane employed in Example 2, before (bottom line) and after (top line) DBD plasma treatment in the chemical shift range 1.6-4.0 ppm.
Figure 11B:
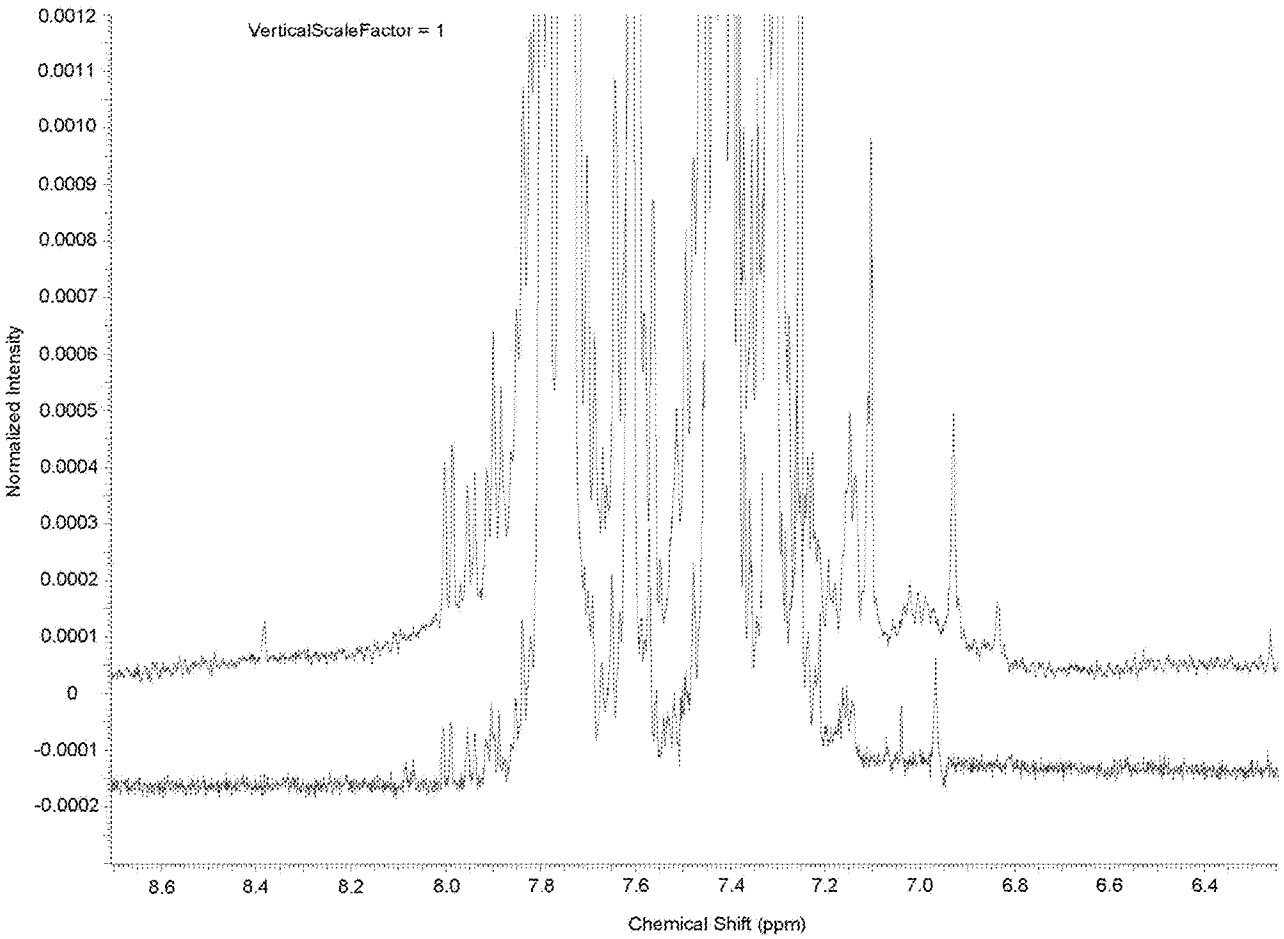
FIG. 11B is an NMR spectra of the liquid mixture of 30% methylnaphthalene and 70% hexadecane before (bottom line) and after (top line) dielectric barrier discharge plasma treatment in the presence of natural gas in the chemical shift range 6.3-8.7 ppm.
Figure 12A:
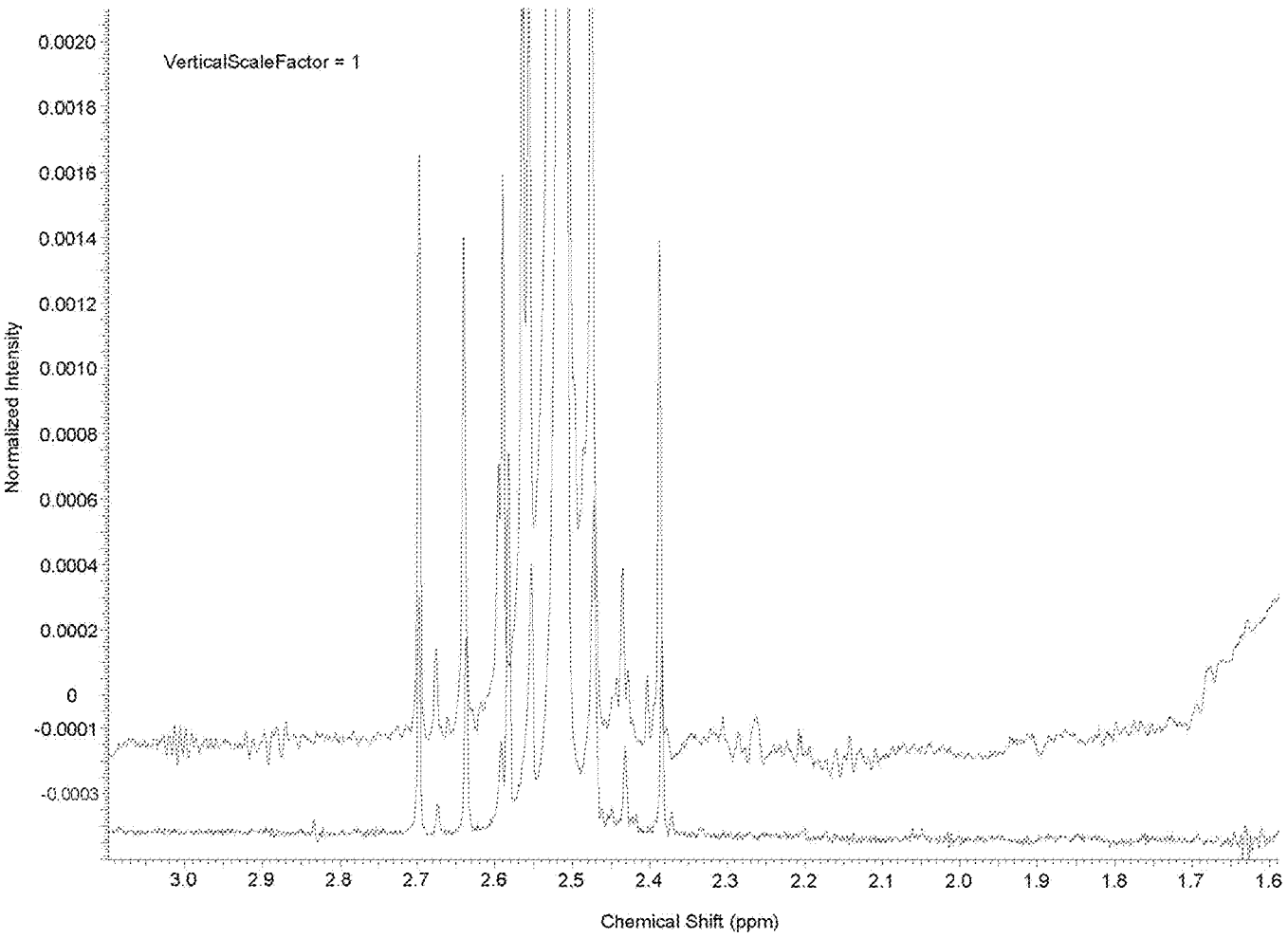
FIG. 12A is an NMR spectra of the liquid mixture of 30% methylnaphthalene and 70% hexadecane employed in Example 2, before (bottom line) and after (top line) APG plasma treatment in the chemical shift range 1.6-4.0 ppm.
Figure 12B:
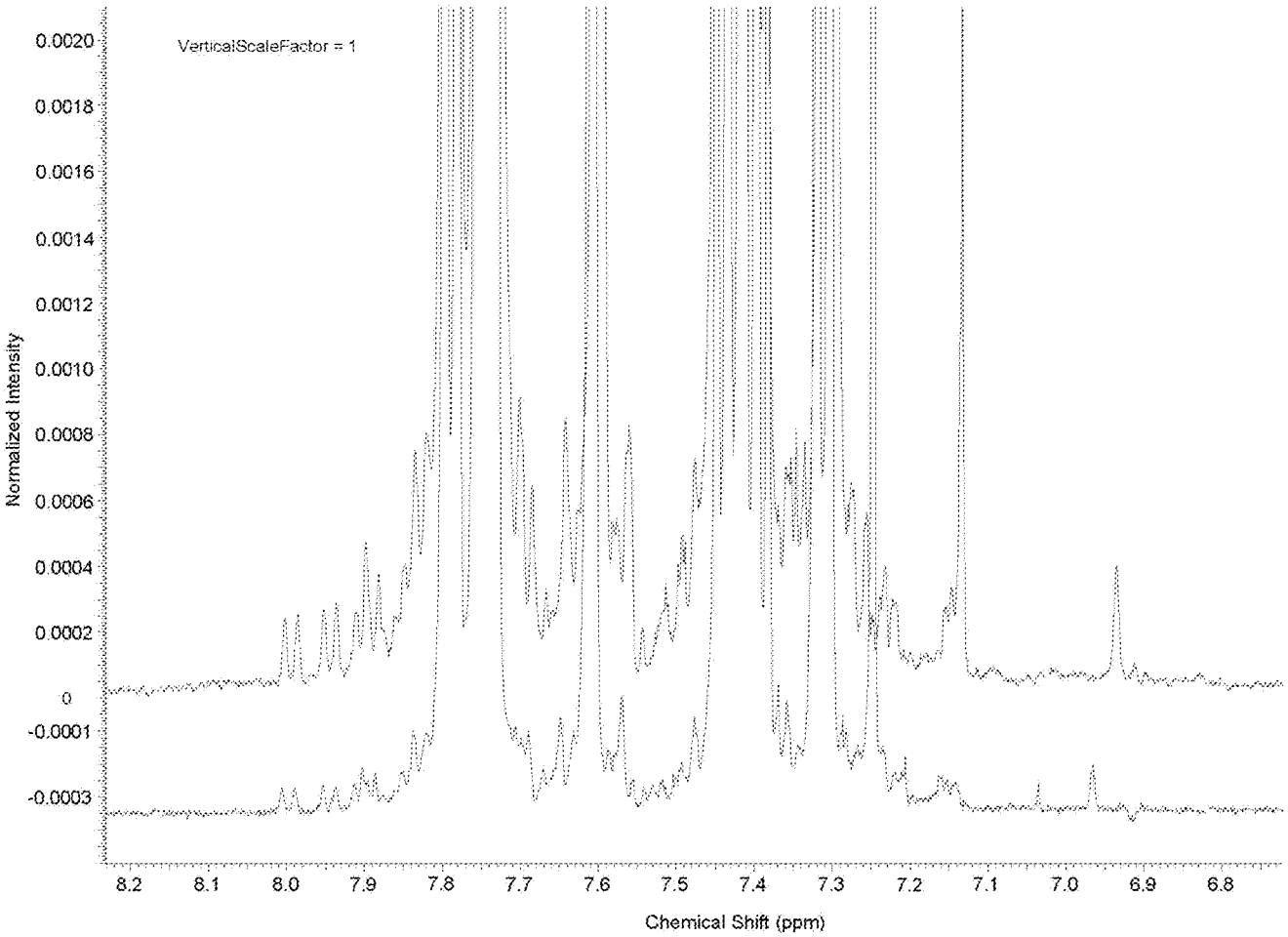
FIG. 12B is an NMR spectra of the liquid mixture of 30% methylnaphthalene and 70% hexadecane before (bottom line) and after (top line) atmospheric pressure glow discharge plasma treatment in the presence of natural gas in the chemical range 6.3-8.7 ppm.

The liquid mixture was treated by two types of discharges: dielectric barrier discharge (DBD) and atmospheric pressure glow discharge (APGD), in the presence of natural gas. The treated liquid mixture (with incorporated methane) was analyzed using nuclear magnetic resonance spectroscopy (NMR). The NMR spectra of FIGS. 11A-11B show a before and after comparison of untreated vs. treated liquid mixtures using DBD. The NMR spectra of FIGS. 12A-12B show a before and after comparison of untreated vs. treated liquid mixtures using APG discharge.

Based on these NMR spectra, after both DBD and APGD treatments, about 90% of the methane was incorporated into aromatic compounds by saturation of the aromatic rings, and only about 10% of the methane was incorporated into the aliphatic compounds by polymerization of the aliphatic compounds. About 85-90% of the aromatic ring saturation resulted from saturation of the first ring of methylnaphthalene. About 10-15% of the methylnaphthalene was converted into aliphatic compounds. Thus, the plasma induced methane liquefaction showed a significant preference for incorporation into aromatic compounds over aliphatic compounds. This is consistent with the fact that, as stated above, the saturation of aromatic rings with methane is an energy efficient process due to its exothermic nature, while the polymerization of aliphatic compounds requires a significant amount of energy since it is an endothermic process.

Example 3

Figure 13A:
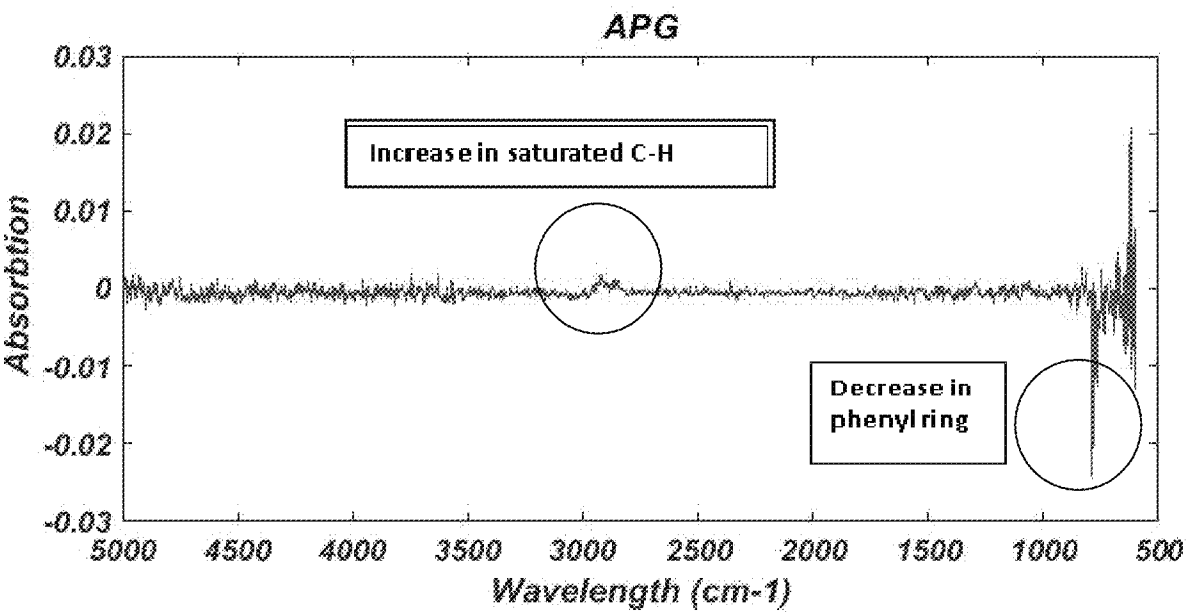
FIG. 13A shows the difference between the Fourier transform infrared spectra before plasma treatment and after atmospheric pressure glow discharge treatment in the presence of natural gas showing an increase in saturation (shown in terms of new C—H bonds) and a decrease in the amount of phenyl rings in the methylnaphthalene as a result of plasma treatment.
Figure 13B:
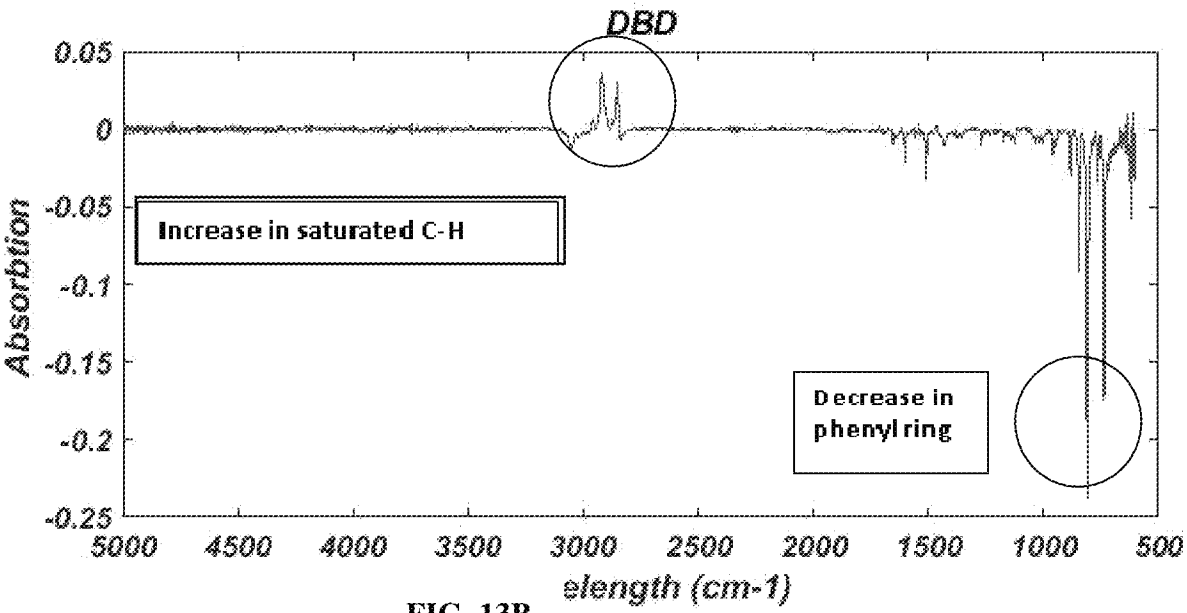
FIG. 13B shows the difference between the Fourier transform infrared spectra before plasma treatment and after dielectric barrier discharge treatment in the presence of natural gas showing an increase in saturation (shown in terms of new C—H bonds) and a decrease in the amount of phenyl rings in the methylnaphthalene as a result of plasma treatment.

Liquid methylnaphthalene ($C_{11}H_{10}$) was treated for 1 hour with DBD and APGD discharge, respectively, in the presence of $CH_4$. Samples of treated liquid were analyzed by Fourier transform infrared spectroscopy (FTIR). The differences between the FTIR spectra before and after plasma treatment were plotted to show the effect of plasma treatment. FIG. 13A shows the differences in the methynaphthalene after APGD treatment and FIG. 13B shows the differences in the methylnaphthalene after DBD treatment. FIGS. 13A-13B demonstrate that there was an increased in saturation (in terms of new C—H bonds) and a decrease in the amount of phenyl rings in the methylnaphthalene as a result of both plasma treatments.

Based on analyses of the spectra, both of the DBD and APGD treatments significantly increased the saturation and decreased the amount of aromaticity of the methylnaphthalene. Overall the total methylnaphthalene decrease after 1 hour of plasma treatment was ~1.7% for APGD and ~2.6% for DBD.

Example 4

In this example, 50 g of low sulfur diesel fuel was treated by APGD in a plasma system according to FIG. 8. A voltage at 2.4 kV and current of 0.62 mA were employed for this example. The gas introduced into the diesel fuel was a mixture of two gas streams: ~2.7 L/min of $CH_4$ and 0.27 L/min of $N_2$. The composition of the reaction mixture was analyzed at 1 minute intervals during the treatment using gas chromatography. The results are shown in Table 1:

TABLE 1

Gas chromatographic analysis (concentrations) of various components of the reaction mixture

| Time, min | H2 | N2 | CH4 | C2H6 | C2H4 | C2H2 |
|---|---|---|---|---|---|---|
| 0 | 0.000 | 8.481 | 91.513 | 0.006 | 0.000 | 0.000 |
| 1 | 0.015 | 10.775 | 89.201 | 0.007 | 0.000 | 0.002 |
| 2 | 0.017 | 10.710 | 89.263 | 0.007 | 0.000 | 0.003 |
| 3 | 0.018 | 10.563 | 89.409 | 0.007 | 0.000 | 0.003 |
| 4 | 0.020 | 10.613 | 89.387 | 0.007 | 0.000 | 0.003 |
| 5 | 0.021 | 10.450 | 89.519 | 0.008 | 0.000 | 0.003 |

The composition of the reaction mixture recalculated in terms of volumes based on the constant $N_2$ flow rate are shown in Table 2:

TABLE 2

Changes of gaseous mixture volumes (in L) during APG plasma treatment of diesel

| Time, min | H2 | N2 | CH4 | C2H6 | C2H4 | C2H2 |
|---|---|---|---|---|---|---|
| 0 | 0.000 | 0.270 | 2.700 | 0.00019 | 0.00000 | 0.00000 |
| 1 | 0.00038 | 0.270 | 2.235 | 0.00018 | 0.00000 | 0.00005 |
| 2 | 0.00043 | 0.270 | 2.250 | 0.00018 | 0.00000 | 0.00008 |
| 3 | 0.00046 | 0.270 | 2.285 | 0.00018 | 0.00000 | 0.00008 |
| 4 | 0.00051 | 0.270 | 2.274 | 0.00018 | 0.00000 | 0.00008 |
| 5 | 0.00054 | 0.270 | 2.313 | 0.00021 | 0.00000 | 0.00008 |

It was observed that, after only five minutes of APGD treatment, the volume of methane was decreased by ~0.4 L. This decrease in the volume of methane cannot be explained by methane dissociation with resultant production of $H_2$, $C_2H_2$ and $C_2H_6$ since the detected amounts of these components are too low to account for the amount of methane reduction. The methane decrease was thus caused by incorporation of the methane into the liquid diesel fuel.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. A method of incorporating a gaseous hydrocarbon into a liquid hydrocarbon, comprising steps of:

exposing the gaseous hydrocarbon to a non-thermal plasma generated using a reduced electric field with an E/N ratio in a range of from about 10 to about 30 Td to provide an activated gaseous hydrocarbon; and contacting the activated gaseous hydrocarbon with the liquid hydrocarbon to incorporate the gaseous hydrocarbon into the liquid hydrocarbon.

2. The method of claim 1, wherein the reduced electric field has an E/N ratio is in a range of from about 12 to about 28 Td.

3. The method of claim 1, wherein the reduced electric field generates electron energy in a range of from about 0.2 eV.

4. The method of claim 1, wherein the reduced electric field is generated by a discharge selected from a high gas flow gliding arc discharge, a microwave discharge, a corona discharge, an atmospheric pressure glow discharge, and a dielectric barrier discharge.

5. The method of claim 1, wherein the discharge is an atmospheric pressure glow discharge that is generated using a voltage in a range of from about 1 kV to about 5 kV.

6. The method of claim 5, wherein the atmospheric pressure glow discharge is generated using a current in a range of from about 0.2 mA to about 10 mA.

7. The method of any claim 5, wherein the atmospheric pressure glow discharge is generated using an alternating current having a frequency in the range of from about 1 kHz to about 500 kHz.

8. The method of claim 1, wherein the gaseous hydrocarbon is selected from methane, ethane, propane, n-butane, iso-butane, tert-butane, and combinations thereof.

9. The method of claim 1, wherein the gaseous hydrocarbon is methane in a natural gas.

10. The method of claim 1, wherein the liquid hydrocarbon is selected from hydrocarbons with a $C_5$ to $C_{28}$ hydrocarbyl group.

11. The method of claim 1, wherein the liquid hydrocarbon is selected from $C_5$ to $C_{20}$ alkanes, alkenes, alkynes, their isomeric forms, and combinations thereof.

12. The method of claim 1, wherein the liquid hydrocarbon is selected from crude oil, gasoline, kerosene, naphtha, diesel oils, gas oils, heating oils, fuel oils, residual oils, and other petroleum products manufactured from crude oil.

13. The method of claim 1, wherein the liquid hydrocarbon is selected from lower grade liquid fuels and synthetic fuels derived from coal, shale oil, bituminous sands, and tar sands.

14. The method of claim 1, wherein the contacting step comprises reducing the liquid fuel to droplets with an average diameter in a range of from about 1 microns to about 30 microns and the droplets are produced using pneumatic nozzles or atomizers.

15. The method of claim 1, wherein in the contacting step, a molar ratio between the gaseous hydrocarbon and the liquid hydrocarbon is in a range of from about 1:20 to about 1:2.

16. The method of claim 1, wherein a catalyst selected from the group consisting of an organometallic compound containing a transition metal, a transition metal-containing compound, and a mixture thereof, is present during the contacting step.

17. The method of claim 16, wherein the transition metal is selected from groups V, VI and VIII of the periodic table.

18. The method of claim 16, wherein the catalyst is a metal naphthenate, an ethyl sulfate, or an ammonium salt of a polyvalent metal anion.

19. The method of claim 16, wherein the catalyst is in the form of pellets, granules, wires, mesh screens, perforated plates, rods, and strips.

20. The method of claim 1, wherein unreacted gaseous hydrocarbon is recycled back to the exposing step.

* * * * *